US011112201B2

(12) United States Patent
Warburton

(10) Patent No.: US 11,112,201 B2
(45) Date of Patent: Sep. 7, 2021

(54) PORTED BARREL SYSTEM FOR FIREARMS

(71) Applicant: Sturm, Ruger & Comany, Inc., Southport, CT (US)

(72) Inventor: Scott Warburton, South Acworth, NH (US)

(73) Assignee: STURM, RUGER & COMPANY, INC.

( * ) Notice: Subject to any disclaimer, the term of this patent is extended or adjusted under 35 U.S.C. 154(b) by 0 days.

(21) Appl. No.: 16/942,074

(22) Filed: Jul. 29, 2020

(65) Prior Publication Data

US 2021/0088301 A1 Mar. 25, 2021

Related U.S. Application Data

(60) Provisional application No. 62/879,587, filed on Jul. 29, 2019.

(51) Int. Cl.
*F41A 21/36* (2006.01)
*F41C 3/14* (2006.01)

(52) U.S. Cl.
CPC ..... *F41A 21/36* (2013.01); *F41C 3/14* (2013.01)

(58) Field of Classification Search
CPC ..... F41A 21/38; F41A 21/34; F41A 21/36
USPC ..... 89/14.2, 14.3; 42/1.06
See application file for complete search history.

(56) References Cited

U.S. PATENT DOCUMENTS 1,786,207 A 12/1930 Hudson
1,901,138 A 3/1933 Barnes
1,948,496 A 2/1934 Barnes
2,112,831 A 4/1938 Cutts
2,496,854 A 2/1950 Crank
2,656,637 A 10/1953 Richards
2,916,970 A * 12/1959 Mutter ..... F41A 21/00 89/14.3
3,367,055 A 2/1968 Powell
3,707,899 A 1/1973 Perrine
(Continued)

FOREIGN PATENT DOCUMENTS

WO WO 2017/171980 10/2017
WO WO 2018/005853 1/2018

OTHER PUBLICATIONS

International Search Report and Written Opinion issued in International Application No. PCT/US20/44021 dated Oct. 22, 2020.

*Primary Examiner* — Reginald S Tillman, Jr.
(74) *Attorney, Agent, or Firm* — The Belles Group, P.C.

(57) ABSTRACT

A barrel porting system for a firearm in one embodiment includes a barrel defining an axially extending barrel bore, a porting device coupled to the barrel and including a plurality of gas portholes in fluid communication with the barrel bore, and an outer shroud encircling at least the porting device. The shroud includes at least one gas discharge port arranged to vent combustion gas from firing the firearm in an outwards direction. An annular gas collection plenum formed between the shroud and porting device is configured to collect gas from the gas portholes and discharge the gas through the at least one discharge port in the shroud. In one implementation, the plenum is formed by a recessed channel in the muzzle device which extends around the entire circumference of the device. Various threaded and unthreaded coupling methods may be used to secure the muzzle device to the barrel.

25 Claims, 31 Drawing Sheets

(56) References Cited

U.S. PATENT DOCUMENTS

| | | | | |
|---|---|---|---|---|
| 4,058,050 | A | 11/1977 | Brouthers | |
| 4,691,614 | A | 9/1987 | Leffel | |
| 4,811,648 | A | 3/1989 | Blackwell et al. | |
| 4,930,396 | A | 6/1990 | Johnson | |
| 5,036,747 | A | 8/1991 | McClain, III | |
| 5,225,615 | A | 7/1993 | Talbot et al. | |
| 5,279,200 | A | 1/1994 | Rose | |
| 5,367,940 | A | 11/1994 | Taylor | |
| 5,675,107 | A | 10/1997 | Ledys et al. | |
| 5,811,714 | A | 9/1998 | Hull et al. | |
| 5,814,757 | A | 9/1998 | Buss | |
| 6,604,445 | B2 * | 8/2003 | Sevastian | F41A 21/36 42/1.06 |
| 6,899,008 | B2 | 5/2005 | Breuer | |
| 7,143,680 | B2 | 12/2006 | Bender | |
| 7,254,913 | B2 | 8/2007 | Dubois et al. | |
| 7,296,505 | B2 | 11/2007 | Balbo et al. | |
| 7,328,645 | B1 | 2/2008 | Curry et al. | |
| 7,353,741 | B2 | 4/2008 | Brixius | |
| D598,516 | S | 8/2009 | Butler | |
| 8,186,261 | B2 | 5/2012 | Mcneill et al. | |
| D682,384 | S | 5/2013 | Jaureguizar | |
| 8,464,625 | B2 | 6/2013 | Polovnev et al. | |
| 8,567,556 | B2 | 10/2013 | Dueck et al. | |
| 8,695,474 | B2 | 4/2014 | Overbeek Bloem et al. | |
| 9,080,829 | B1 | 7/2015 | Cellini | |
| 9,134,084 | B1 | 9/2015 | Harrison et al. | |
| 9,151,560 | B2 | 10/2015 | Myers et al. | |
| 9,377,263 | B1 | 6/2016 | Sy | |
| D760,859 | S | 7/2016 | Venegas | |
| 9,417,024 | B2 | 8/2016 | Miller, III | |
| D767,076 | S | 9/2016 | Bebee | |
| 9,513,078 | B1 | 12/2016 | Fulton et al. | |
| 9,562,734 | B2 | 2/2017 | Wilson | |
| 9,885,533 | B2 | 2/2018 | Griffitts | |
| 9,903,678 | B2 | 2/2018 | Sherrill | |
| 9,995,550 | B2 | 6/2018 | Shelton et al. | |
| 1,003,660 | A1 | 7/2018 | Kosman | |
| 10,145,637 | B2 | 12/2018 | Hwang et al. | |
| 10,156,412 | B1 | 12/2018 | Price | |
| 2010/0275493 | A1 | 11/2010 | Polovnev | |
| 2013/0227871 | A1 | 9/2013 | Stone | |
| 2016/0123689 | A1 | 5/2016 | Maeda | |
| 2017/0295179 | A1 | 7/2017 | Chavez | |
| 2017/0299313 | A1 | 10/2017 | Adamson, Jr. | |
| 2018/0238654 | A1 | 8/2018 | Barry et al. | |

* cited by examiner

PORTED BARREL SYSTEM FOR FIREARMS

CROSS-REFERENCE TO RELATED APPLICATIONS

The present application claims priority to U.S. Provisional Patent Application Ser. No. 62/879,587 filed Jul. 29, 2019, which is incorporated herein by reference in its entirety.

BACKGROUND OF THE INVENTION

The present invention relates to firearms, and more particularly to a ported barrel system which compensates for muzzle rise and recoil when discharging the firearm.

When a firearm is discharged thereby releasing high velocity combustion gases forward from the muzzle end of the barrel, recoil forces are generated which act to drive the firearm in a rearward opposite direction towards the user. This creates what is sometimes referred to as "felt" recoil.

These same high velocity combustion gases also concurrently tend to drive the muzzle end of the barrel upwards, which is referred to as muzzle rise. Muzzle rise is particularly prevalent in handguns since the user grasps the hand grip in a position below the centerline of the barrel bore through which the projectile is fired. This creates a moment about the user's hand, thereby resulting in an increased tendency for the barrel to rise after each shot. Muzzle rise however still occurs with shouldered long guns. Muzzle rise adversely affects the point of aim requiring the user to expend more time and effort between shots to reacquire the target and aim the firearm back down field for the follow up shot each time the firearm is discharged.

Both of the foregoing recoil and muzzle rise effects resulting from firing the firearm and associated release of combustion gases adversely affects shooting accuracy. This is a particularly important factor in competitive shooting matches.

An improved barrel system is needed which effectively compensates for both recoil and muzzle rise while preserving a compact firearm profile and offering ease of assembly.

SUMMARY

Exemplary embodiments of the present disclosure provide an easily assembled barrel porting system configured and operable to compensate for both recoil and muzzle rise in a compact assembly. Advantageously, the present barrel porting system utilizes an internal porting system and an external porting system formed by discrete components which interact in a manner which effectively minimizes recoil and muzzle rise.

A first feature of the barrel porting system includes a porting device which comprises an array of radially oriented gas portholes in the barrel. The porting device may be considered to form a muzzle brake. The portholes are configured and arranged proximate to the muzzle end of the barrel in one embodiment for venting the combustion gases from the barrel bore in a controlled manner for a full 360 degrees around the circumference of the barrel. This full circumferential release of gases reduces the exiting gas velocity from the muzzle end of the barrel by providing a greater cumulative open flow area for extracting and venting the gas form the barrel bore. The gas portholes may be arranged in a 360 degree array around the top, bottom, and both lateral sides of the barrel in one embodiment, or optionally an alternative detachable porting device comprising the same array of gas portholes may be removably coupled to the muzzle end of the barrel in various embodiments. In one arrangement, the gas portholes may be substantially uniformly or equally arranged and spaced apart around entire circumference of the barrel or porting device to produce uniform gas flow and less disturbance or unbalanced forces on the axially exiting projectile (e.g. bullet or slug) from the barrel, thereby advantageously resulting in better shooting accuracy.

A second feature of the barrel porting system may include an outer shroud which at least partially covers the barrel, and preferably covers at least the portion of the barrel or removable porting device coupled thereto which contains the gas portholes. The barrel and muzzle brake are nested inside the shroud which is configuration to direct and control the flow of gas from the portholes. An internal circumferentially-extending annular gas collection channel which defines a plenum is formed between the shroud and barrel or alternatively detachable porting device. The plenum is in direct fluid communication with the gas portholes for collecting combustion gases resulting from discharging the firearm. In one embodiment, the plenum may be formed by a circumferentially-extending recessed band or channel portion formed in an exterior surface of the porting device or barrel. One or multiple gas plenums may be provided in various embodiments. One or more gas discharge ports are formed in the shroud for venting the combustion gases from the collection plenum in a controlled manner to atmosphere to control and minimize muzzle rise. In one embodiment, the gases are vented transversely and perpendicularly to the longitudinal axis of the firearm barrel. The discharge ports preferably may be formed on the upper half of the shroud to compensate for muzzle rise. The ports vent gas outward, and in some embodiments preferably in a generally upward direction.

In certain embodiments, a two-piece shroud may be provided comprising a fixed rear portion and a detachable front portion or cap. The shroud cap encircles the gas portholes of a detachable muzzle brake and includes the one or more discharge ports. Both the detachable shroud cap and muzzle brake greatly facilitate cleaning carbon deposits from each contained in the vented combustion gases which accumulate over time on surfaces exposed to the gases.

The muzzle brake feature of the barrel porting system may be either integral with the barrel being formed as a unitary structural part thereof, or a separate detachable device in fluid communication with the barrel bore. By diverting some of the combustion gases transversely from the barrel bore, the total volume of combustion gases released in the forward direction from the terminal muzzle end of the barrel along the longitudinal axis is reduced, thereby effectively decreasing the rearward recoil forces generated by discharging the firearm. The gas discharge port(s) arranged on the upper half of the shroud forms the part of the porting system which reduces muzzle rise. By discharging the vented combustion gases in a generally upwards direction from the shroud discharge port(s), the vertically acting dynamic forces associated with muzzle rise which act in an upwards direction are counterbalanced by the vertically acting downward forces by the gas jetted from the discharge port(s). The combined effect of the muzzle brake and muzzle rise features provides a smoother and controlled firing experience to the user which advantageously results in greater accuracy.

A thread-less coupling system may be provided which detachably secures the porting device such as a muzzle brake to the barrel. Unlike threaded couplings, the thread-less muzzle brake coupling system is designed to be less prone to loosening after repeated firings to preserve the integrity of the gas seals and eliminate the need to retighten the muzzle brake. In other embodiments, the muzzle brake may be threaded onto the barrel.

The present barrel porting system is adaptable and usable for handguns (e.g. revolvers and pistols) and long guns (e.g. rifles, shotguns, etc.). Accordingly, the barrel porting system is not limited in its applicability.

According to one aspect, a barrel porting system for a firearm comprises: a barrel including a longitudinal axis, a muzzle end, and an axially extending barrel bore which defines a projectile pathway; a detachable porting device removably coupled to the barrel, the porting device comprising a plurality of gas portholes in fluid communication with the barrel bore; an elongated outer shroud encircling the porting device, the shroud including at least one gas discharge port arranged to vent combustion gas from firing the firearm in an outwards direction; and an annular gas collection plenum formed between the shroud and porting device, the plenum configured to collect gas from the gas portholes and discharge the gas through the at least one discharge port in the shroud.

According to another aspect, a firearm comprising the foregoing barrel porting system comprises: a frame or receiver supporting the barrel; a trigger-actuated firing mechanism positioned in the frame or receiver, the firing mechanism including a trigger coupled to a movable striking member operable to discharge the firearm via a trigger pull; and wherein discharging the firearm causes combustion gas to flow outwards from the gas portholes into the gas collection plenum, circulate through the plenum to the at least one gas discharge port in the shroud, and then flow outwards from the at least one discharge port to atmosphere.

According to another aspect, a barrel porting system for a firearm comprises: a barrel including a longitudinal axis, a muzzle end, and an axially extending barrel bore which defines a projectile pathway; a plurality of gas portholes formed in a venting portion of the barrel in fluid communication with the barrel bore; and an outer shroud encircling at least the venting portion of the barrel, the shroud including at least one gas discharge port in fluid communication with the gas portholes of the barrel and arranged to vent combustion gas from firing the firearm in a generally upwards direction.

According to another aspect, a barrel porting system for a firearm comprises: a frame or receiver; a barrel supported by the frame or receiver and including a longitudinal axis, a muzzle end, and an axially extending barrel bore which defines a projectile pathway; a detachable porting device removably coupled to the barrel, the porting device comprising a plurality of gas portholes in fluid communication with the barrel bore; an elongated outer shroud encircling the barrel, the shroud comprising a rear shroud portion coupled to the frame or receiver and a front shroud cap detachably coupled to the rear shroud portion; the shroud cap including at least one gas discharge port arranged to vent combustion gases from firing the firearm in a generally upwards direction; and an annular gas collection channel formed between the shroud cap and porting device, the channel operable to collect gas from the gas portholes and discharge the gas through the at least one discharge port in the shroud.

According to another aspect, a method for porting gas from a firearm comprises: providing a firearm including a barrel including an axially extending barrel bore which defines a projectile pathway, and a muzzle device coupled to the barrel and in fluid communication with the barrel bore; firing the firearm; radially discharging combustion gas from the barrel bore through an array of gas portholes in the muzzle device; receiving the gas in an annular gas plenum defined by the muzzle device, the gas collection plenum extending 360 degrees around a circumference of the muzzle device; and discharging the gas from the gas collection plenum through at least one gas discharge port formed in an outer shroud surrounding the muzzle device.

BRIEF DESCRIPTION OF THE DRAWINGS

The features of the exemplary ("example") embodiments will be described with reference to the following drawings where like elements are labeled similarly, and in which:

All drawings may be considered schematic and not necessarily to scale. Features numbered in some figures which appear un-numbered in others are the same unless noted otherwise. A reference to a figure by its whole number (e.g. FIG. 4) which includes multiple figures with different alphabetical suffixes (e.g. FIGS. 4A and 4B) shall be construed as a reference to all the figures.

DETAILED DESCRIPTION

Figure 1:
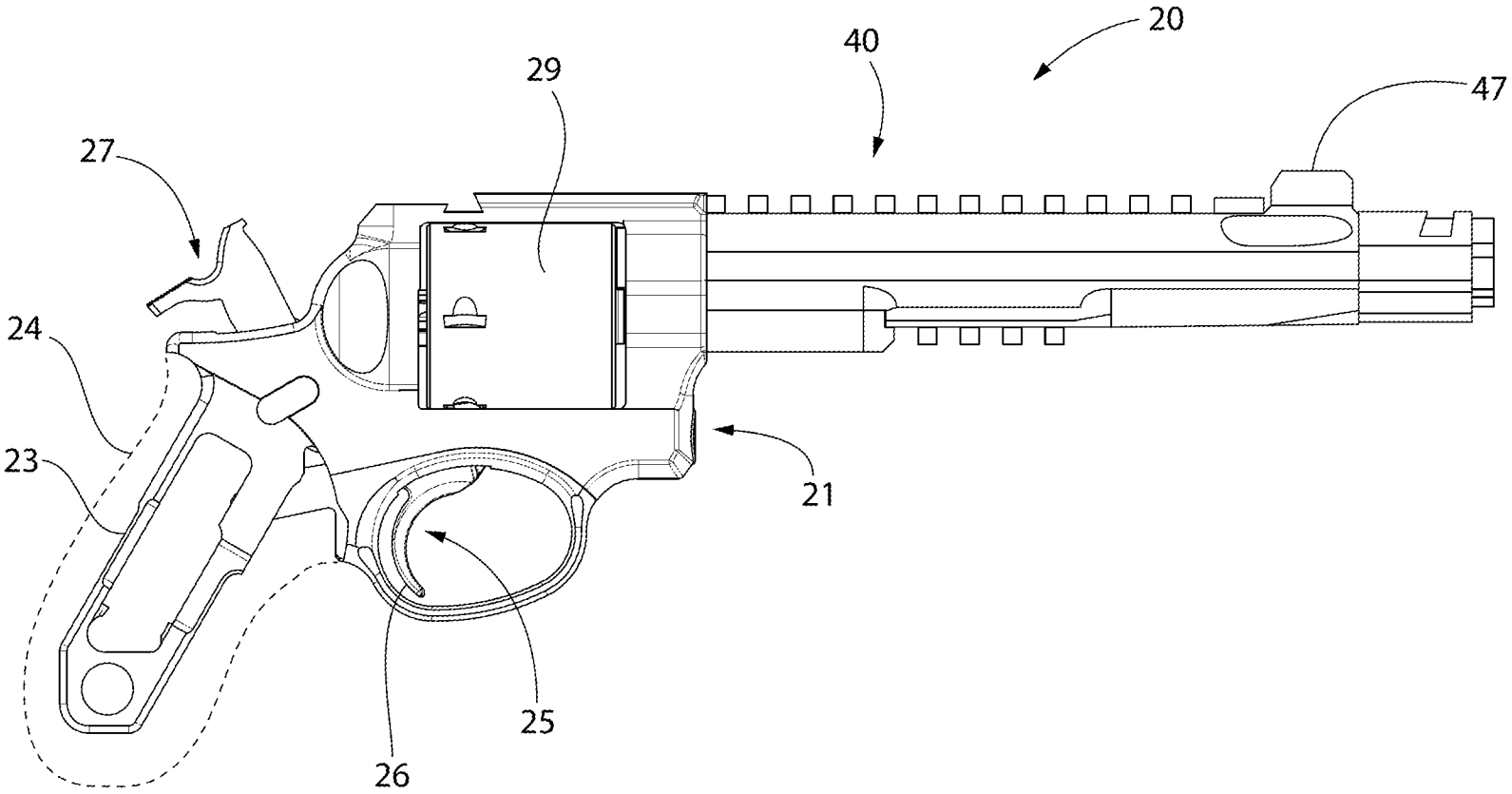
FIG. 1 is a right side view of a firearm with a first embodiment of a barrel porting system according to the present disclosure.

The features and benefits of the invention are illustrated and described herein by reference to example ("exemplary") embodiments. This description of exemplary embodiments is intended to be read in connection with the accompanying drawings, which are to be considered part of the entire written description. In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," and "interconnected," refer to a relationship wherein structures are secured or attached to one another either directly or indirectly through intervening structures, as well as both movable or rigid attachments or relationships, unless expressly described otherwise. Accordingly, the disclosure expressly should not be limited to such exemplary embodiments illustrating some possible non-limiting combination of features that may exist alone or in other combinations of features.

As used throughout, any ranges disclosed herein are used as shorthand for describing each and every value that is within the range. Any value within the range can be selected as the terminus of the range.

The accompanying figures depict different embodiments of the present barrel porting system, as further described herein.

Figure 2:
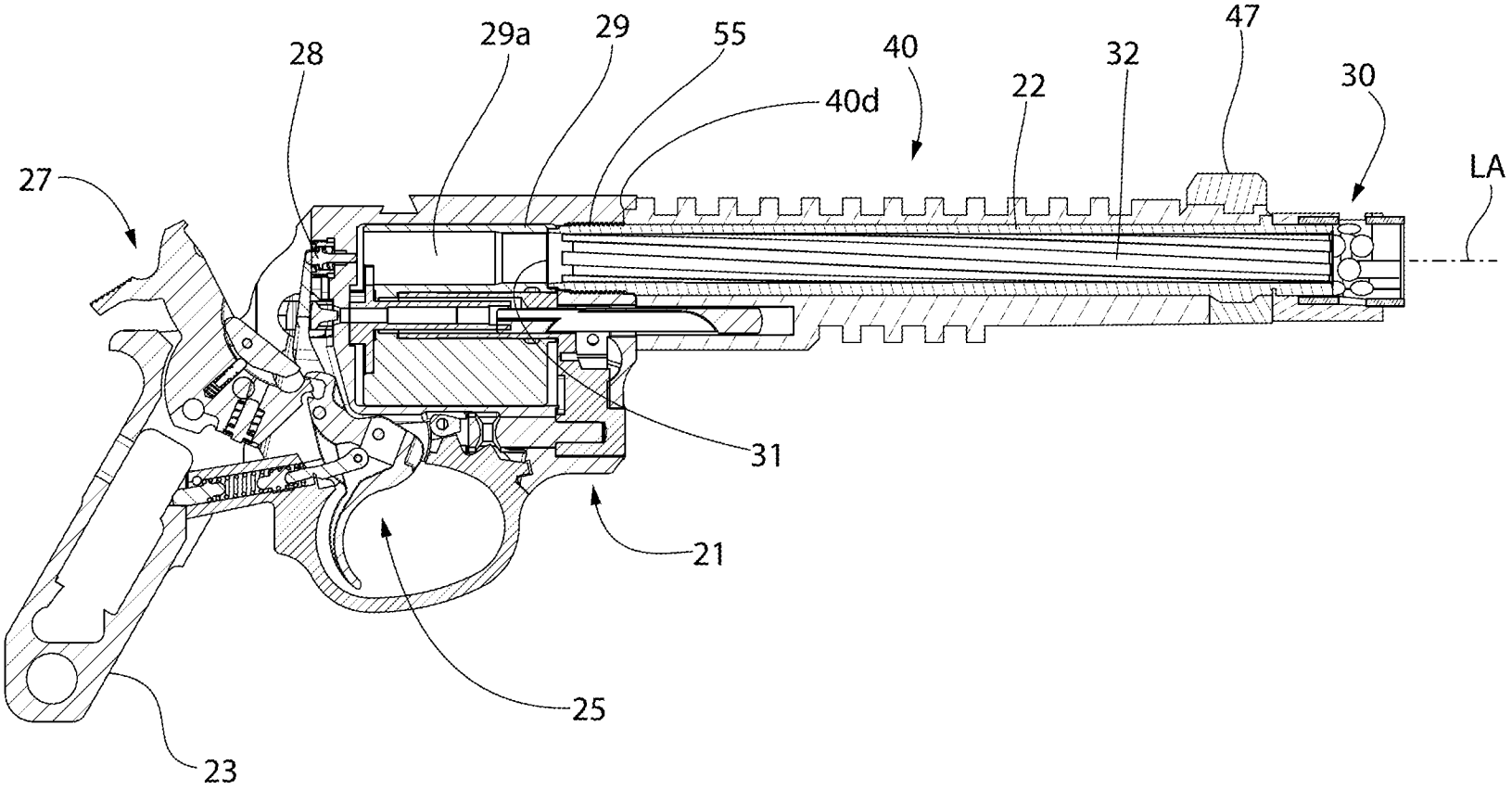
FIG. 2 is a cross-sectional view thereof.
Figure 3:
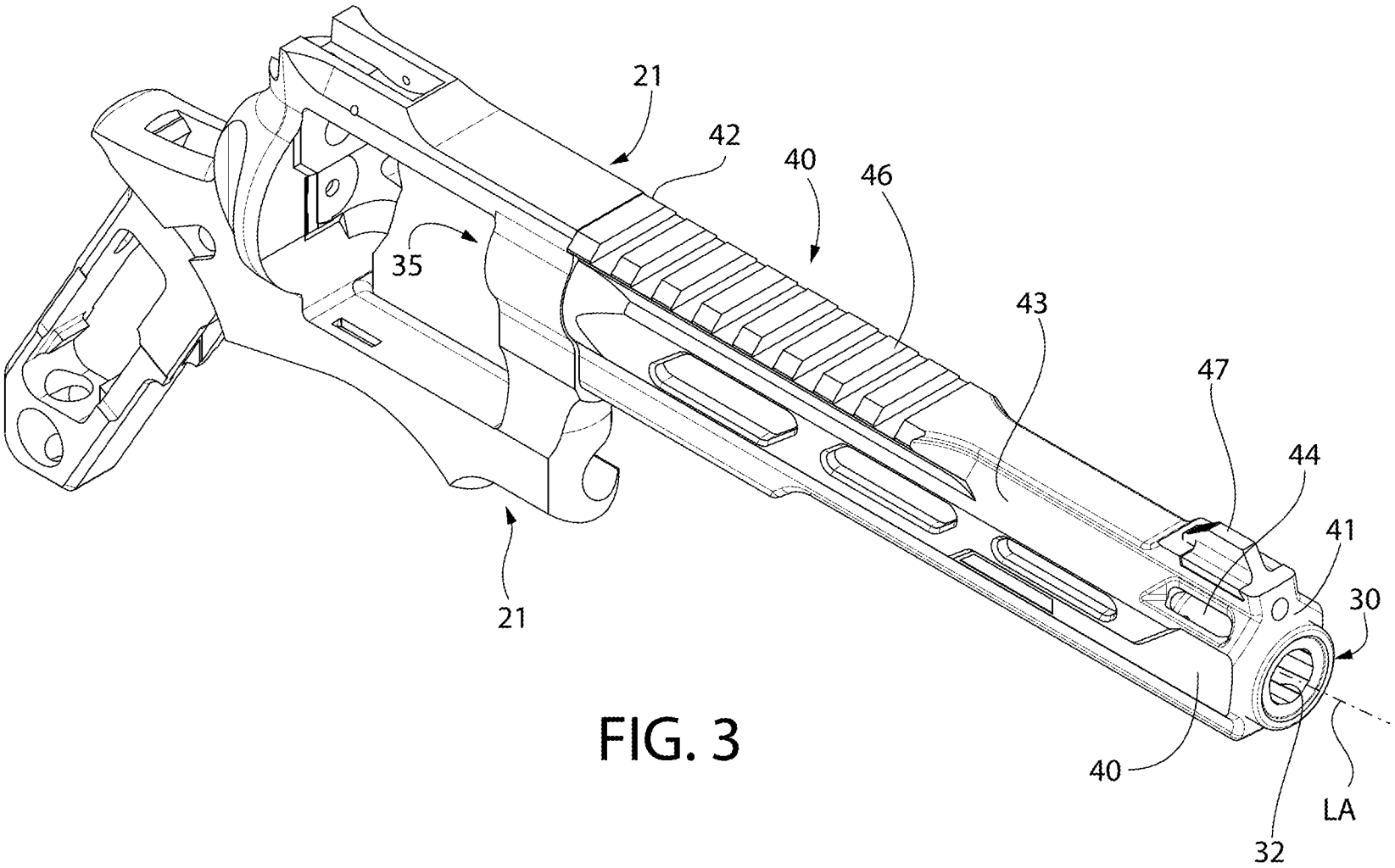
FIG. 3 is a right side perspective view thereof.

FIGS. 1 and 2 depict one non-limiting example of a firearm in the form of a revolver which includes an embodiment of the present barrel porting system. Although the firearm illustrated is a revolver, the invention is not so limited. Accordingly, it will be appreciated by one skilled in the art that the barrel porting system may be used on other types of firearms with equal benefit in which it is desirable to reduce felt recoil and muzzle rise. This includes without limitation handguns such as semi-automatic pistols, or long guns such as rifles (including carbines) or shotguns.

Referring to FIGS. 1 and 2, the revolver 20 generally includes a frame 21 supporting a barrel 22 and trigger-actuated firing mechanism 23. When in the form of a handgun such as the illustrated revolver or alternatively a pistol, the frame generally includes a vertically elongated rear grip portion or tang 23 for attaching the grip 24 for grasping. It bears noting that for a revolver or pistol, the portion of the frame which supports the barrel 22 may alternatively be considered and referred to as a "receiver" in the art. In the case of a long gun (e.g. rifle or shotgun), the receiver which supports the barrel is typically a separate part which is mounted to the frame in some manner. The terms "frame" and "receiver" may therefore be used interchangeably when referring to the portion of the revolver or pistol which supports the barrel.

The trigger-actuated firing mechanism 25 operates to discharge the firearm in a known conventional manner. The firing mechanism may generally comprise a movable trigger 26 slideably or pivotably mounted to the frame and spring-biased striking member which may be a pivotable hammer 27 as shown operably coupled to the trigger directly or via an intermediate mechanical trigger linkage (e.g. sear, trigger bar, etc.). The hammer 27 is configured and arranged to strike a firing pin 28 slideably disposed in the frame. The firing pin has a front tip which is projectable in a forward direction when struck by the hammer to in turn strike the percussion cap on a chambered cartridge. Pulling the trigger cocks and releases the hammer to strike the firing pin and discharge the firearm. Such revolver firing mechanisms are well known in the art without further elaboration.

In the case of a conventional semi-automatic pistol (not shown) having an axially reciprocatable slide mounted on the frame in a known manner, it bears noting the mechanical linkage may be a rotatable sear. The sear is configured and operable to hold the spring-biased hammer or alternatively a spring-biased linearly movable striker in a rearward cocked and ready-to-fire position until the trigger is pulled. Pulling the trigger with a closed breech rotates the sear and releases the cocked hammer or striker to strike the firing pin. The firing pin in turn strikes a chambered cartridge and discharges the pistol. Such a pistol firing mechanism is well known in the art without further elaboration.

Figure 4A:
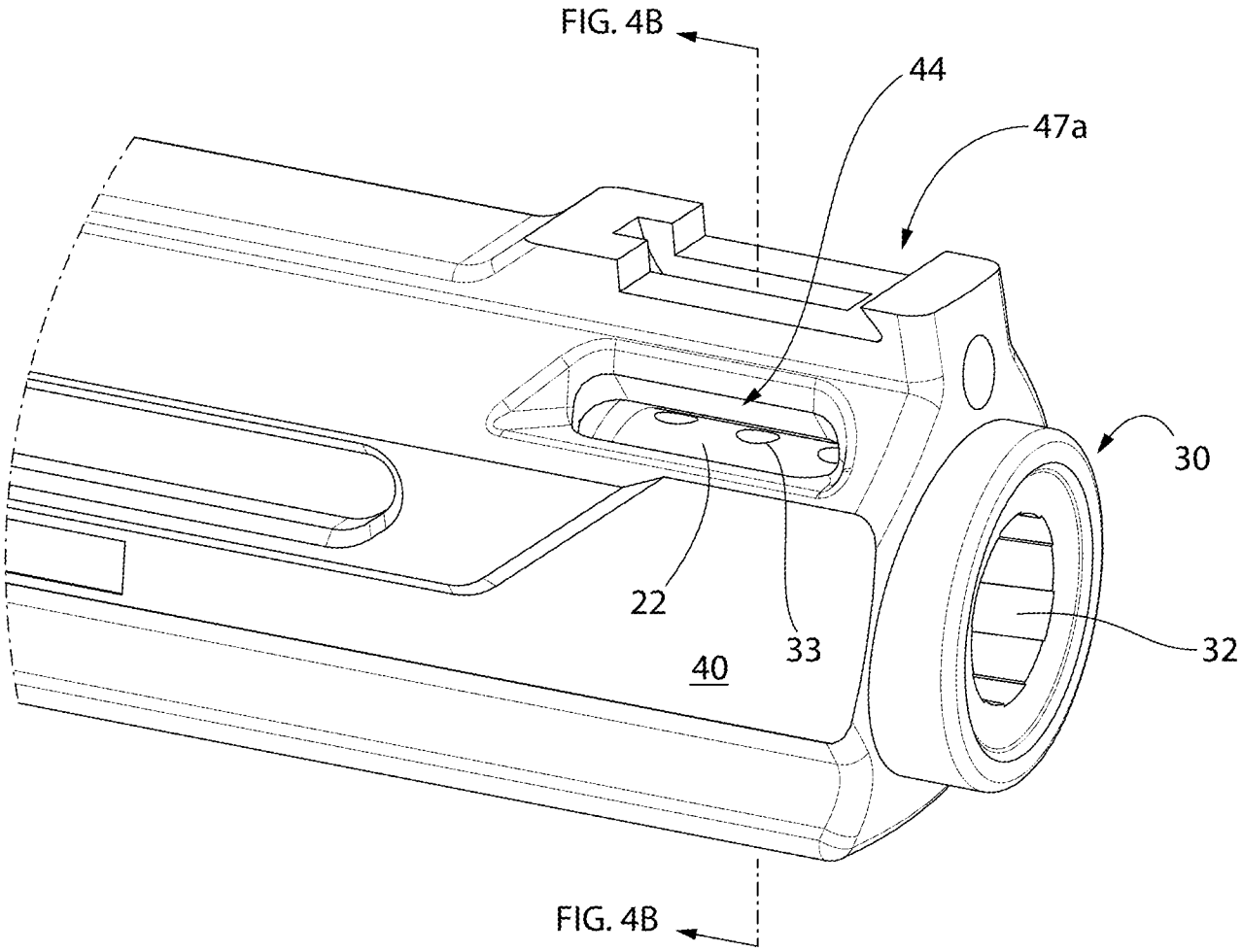
FIG. 4A is an enlarged view of the muzzle end of the firearm.
Figure 4B:
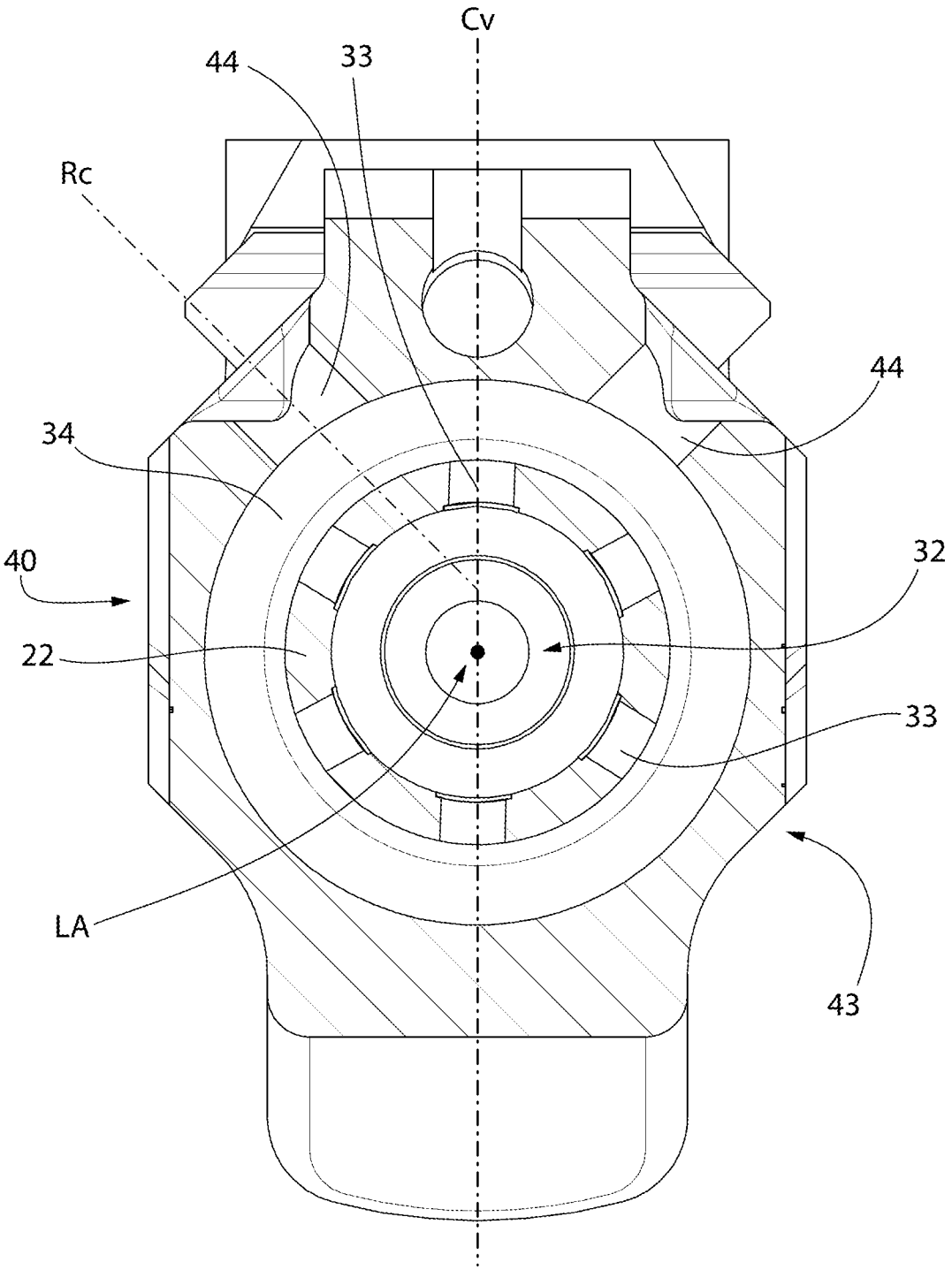
FIG. 4B is a transverse cross-sectional view taken from FIG. 4A.
Figure 5:
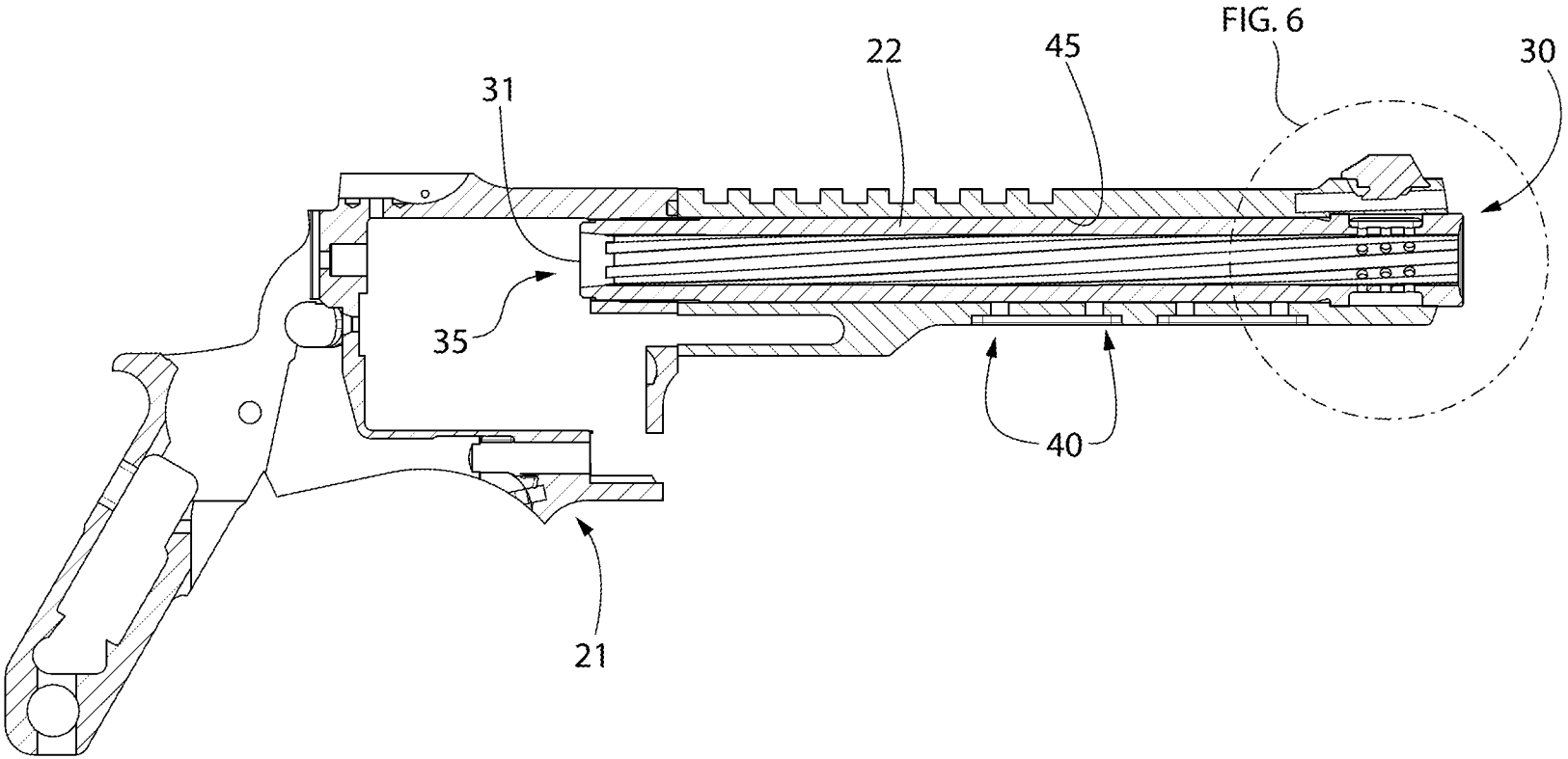
FIG. 5 is a right side cross-sectional view of the frame or receiver, shroud, and barrel with muzzle brake of the firearm of FIG. 1.

With reference to FIGS. 3-8, the barrel 22 includes a front muzzle end 30 and an opposite rear breech end 31 (seen in FIG. 5). The breech end may be coupled to the frame 21, such as via a threaded coupling between the barrel and frame in one non-limiting embodiment. Other non-threaded means may be used to couple the barrel to the frame in other embodiments. A longitudinally extending bore 32 is defined between the ends of the barrel which forms a projectile pathway for a bullet or slug. The centerline of the barrel bore defines a longitudinal axis LA and axial direction. The bore 32 may be rifled or unrifled in various embodiments. A breech area 35 (or simply "breech") is defined at the rear end of barrel. In the case of a revolver as illustrated in the exemplary embodiment, the rear breech end is located forward and adjacent to a revolving cylinder 29 rotatably carried by frame 21 and which includes a plurality of rotatable cartridge chambers 29*a* each configured for holding a cartridge in typical fashion. The cylinder is rotated via operation of a pawl operably connected to and movable with the trigger mechanism, and sprocket or ratchet assembly on the rear of the cylinder engaged by the pawl each time the trigger is pulled. This rotates a different chamber with cartridge into axial alignment with the barrel bore each time the trigger is pulled. Such pawl and sprocket/ratchet mechanisms for revolvers are well known in the art.

In the case of a semi-automatic pistol having a conventional axially reciprocating slide mounted on the frame (not shown), the slide includes a forward facing breech face which creates a closed breech when in battery with the rear breech end of the barrel for firing the pistol, or an open breech for extracting/ejecting spent cartridge casings and loading fresh cartridges into a chamber formed at the breech end of the barrel when spaced rearward from the barrel. In other pistol embodiments such as the Ruger® Mark IV™ rimfire pistol having a barrel-receiver assembly fixedly mounted on the frame, a reciprocating bolt mounted in the receiver forms the axially reciprocating breech face which performs the forgoing functions. Either type of pistol are well known in the art without further elaboration or illustration and usable with the present barrel porting system.

FIGS. 3-8 depict various views of a first embodiment of a barrel porting system according to the present disclosure which includes the muzzle brake portion of the system directly integrated into the barrel. In this first embodiment, the muzzle brake feature or aspect of the barrel porting system which comprises the array of radial gas portholes 33 is formed (e.g. drilled or otherwise machined or cast) integrally and directly in the muzzle end 30 portion of the barrel body as a unitary structural portion thereof. There are no separate or discrete porting devices attachable to the barrel which contain the gas portholes.

Referring still to FIGS. 3-8, the "fixed" barrel porting system comprises the radially vented barrel 22 and longitudinally elongated outer shroud 40 which circumferentially encircles at least a portion of the barrel. A plurality of gas portholes 33 are formed in a forward venting portion of the barrel preferably proximate to and immediately rearward of the muzzle end 30. The portholes are arrayed circumferentially 360 degrees around the barrel 22 and define a "fixed" muzzle brake integrally formed as part of the barrel. The portholes 33 may have a circular shape as shown in one embodiment; however, other non-polygonal shapes including oval or polygonal shapes may be used in other embodiments. The portholes preferably may be uniformly and evenly spaced apart around the circumference and longitudinally from each other on the venting portion for uniform gas flow extraction from the barrel 22 and distribution. In the illustrated embodiment, the portholes 33 may be arranged for example without limitation in three longitudinally spaced apart rings or circular arrays CA of holes around the circumference of the barrel. More or less circular arrays of portholes may be used in other embodiments. At least one porthole 33 is preferably formed in the top, bottom, and each opposing right and left side of the barrel (the right and left designations being from the shooter's perspective holding the firearm and looking forward towards the muzzle end of the barrel). In other embodiments, the spacing and arrangement of portholes 33 may be non-uniform.

Figure 17:
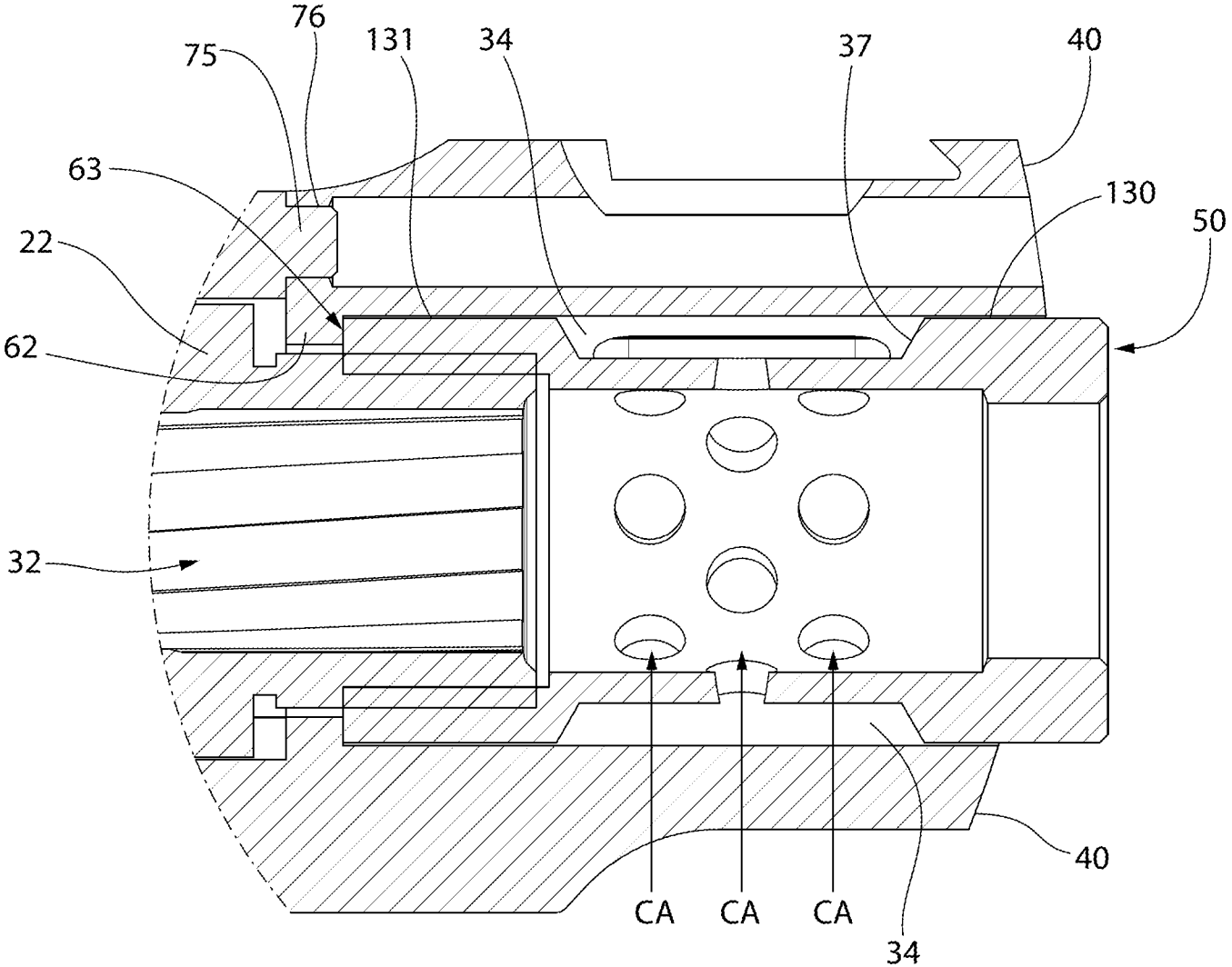
FIG. 17 is an enlarged detail from FIG. 16.
Figure 18:
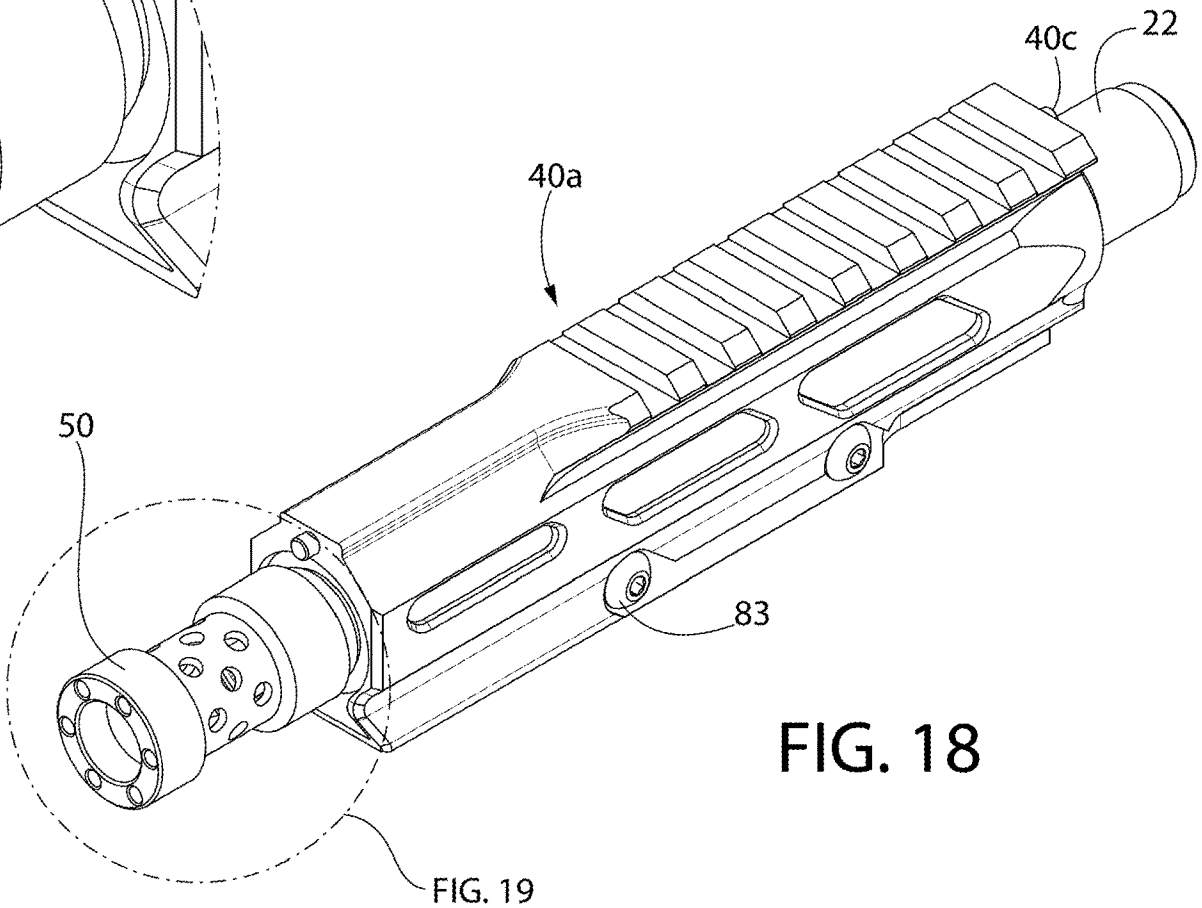
FIG. 18 is a front perspective view of the porting system of FIG. 9A with front shroud cap removed.
Figure 19:
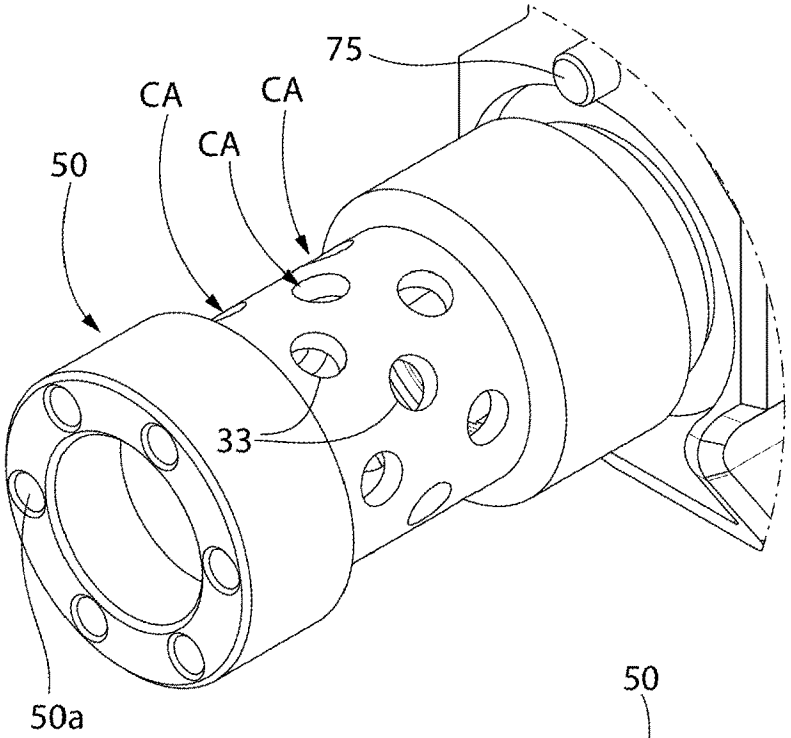
FIG. 19 is an enlarged detail from FIG. 18.

Various arrangements of the gas portholes 33 in each circular array CA may be used. For example, the portholes 33 in each circular array CA may be circumferentially staggered in location from the portholes in each adjacent circular array (see, e.g. FIG. 17 showing removable muzzle device further described elsewhere), or may be substantially circumferentially aligned with each other in every circular array such that a reference line drawn parallel to longitudinal axis LA through a porthole in one circular array may at least partially intersect a porthole in at least one adjacent circular array (see, e.g. FIG. 6). Each porthole 33 is radially oriented and in fluid communication with the barrel bore 32 for drawing a portion of the combustion gases off in a direction transverse to the longitudinal axis. In one configuration, the centerline CL of the portholes may intersect and are perpendicularly oriented to the longitudinal axis. In other possible embodiments, the centerlines of some or all of the portholes 33 may be acutely angled to the longitudinal axis LA and/or offset therefrom such that the centerlines do not intersect the longitudinal axis.

Figure 6:
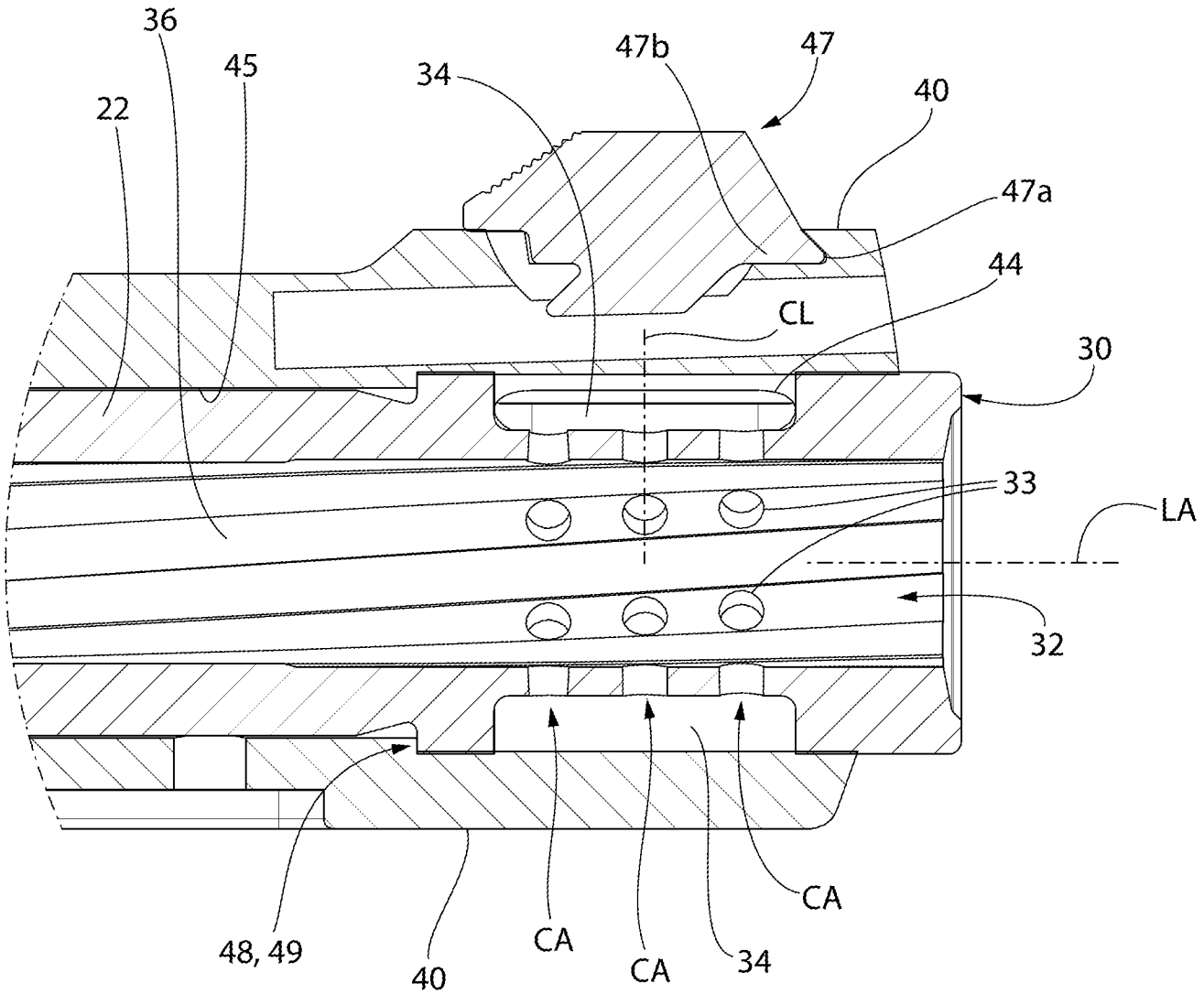
FIG. 6 is an enlarged detail from FIG. 5.

When the radial gas portholes 33 are formed directly in a rifles barrel 22 in the fixed barrel porting system, the portholes preferably may be located within and directly through the longitudinally-extending rifling grooves 36 as shown in FIG. 6. This protects the portholes from wear by the slug or bullet as it travels down the barrel bore 32. However, the gas portholes 33 need not necessarily be located within the rifling grooves. Accordingly, other embodiments may have the gas portholes located through the full thickness of the barrel 22.

With continuing reference to FIGS. 3-8, the outer shroud 40 preferably has an axial (longitudinal) length which covers at least the venting portion of the barrel adjacent to its muzzle end as shown. In one embodiment, the shroud 40 may extend for a majority, or substantially the entire length of the barrel. When the barrel 22 is axially inserted into the shroud, the outwardly open gas portholes 33 become enclosed by the shroud.

The shroud 40 generally includes an open front end 41, open rear end 42, and a generally circumferential wall 45 circumscribing the barrel 22 and extending longitudinally between the ends along longitudinal axis LA of the firearm. Circumferential wall 45 may have any suitable cross-sectional shape or profile (see, e.g. FIG. 4B) including portions such as the downward extension shown which is spaced distally from the barrel 22. The cross-sectional shape may in part be dictated by the frame 21 to provide a substantially uniform and pleasing visual appearance. The rear end 42 may be abutted to the firearm frame 21 and secured in place on the firearm by any suitable means. The shroud 40 defines an axially-extending open internal longitudinal cavity 45 between the ends configured to slideably receive the barrel therein. The longitudinal cavity 45 may be complementary configured and dimensioned to the barrel to form a relatively tight fit with the barrel thereby avoiding any substantial annular gaps or space between at least the forward portion of the barrel and interior surface of the shroud to reduce vibration or chatter when firing the firearm.

The shroud 40 can accommodate various accessories. As shown, the shroud 40 may be configured with a front sight mounting interface for detachably or permanently mounting a front sight 47 thereto. In one embodiment, the interface may comprise a transversely oriented full or partial dovetail slot 47*a* which receives a mating dovetail protrusion 47*b* formed on the bottom of the sight. In other embodiments, a fixed sight integrally formed with the shroud 40 may be provided. The shroud may further include accessory rails 46 (e.g. Picatinny or other) on the top and/or bottom in certain embodiments.

The barrel porting system in one embodiment further includes an enlarged circumferentially extending annular gas collection channel 37 defining a gas collection plenum 34 between barrel 22 and the shroud 40. The channel/plenum circumscribes the barrel and extends a full 360 around its exterior. In one embodiment, the channel 37 may be recessed into the exterior surface of the barrel, and may be formed by a reduced diameter intermediate portion of the barrel which defines a circumferentially-extending recessed band which defines the annular plenum 34 (see, e.g. FIG. 8). The channel 37 may be bounded at its front and rear by full diameter portions of the barrel that interface with the interior surface of the shroud 40 to form front and rear gas seals 130, 131. Each gas porthole 33 in the barrel 22 is preferably formed within the gas collection channel 37 so that the annular gas collection plenum 34 receives gas directly from the barrel bore 32 exiting through the portholes 33 when the firearm is fired. The gas portholes 33 are therefore in direct fluid communication with the annular gas collection channel 37 and defined plenum 34. The channel 37 is longitudinally broad having a greater axial length than at least twice its radial depth, and preferably in some embodiments greater than at least three times its depth. The axial length of the barrel recessed channel 37 and concomitantly the gas collection plenum 34 (measured along longitudinal axis LA) may vary depending on the number and longitudinal spacing of the array of gas portholes provided in the barrel so that each porthole is preferably located within and radially vents directly into the channel from the barrel bore to minimize pressure drop and maximize the amount of combustion gas extracted from the barrel bore.

It bears noting that the recessed channel 37 is not merely an interface space between the barrel 22 and interior surface of shroud 40. Instead, the channel 37 which defines plenum 34 has a pronounced depth which is sufficient to collect a large volume of high pressure combustion gas extracted from the barrel bore 32 via gas portholes 33, and distribute that gas to the discharge port(s) 44 in shroud 40.

In other possible embodiments, the annular gas collection plenum 34 may instead be formed on the interior surface of the shroud 40 by providing the circumferentially-extending recessed channel in the shroud in lieu of the barrel 22. In such a construction, the barrel may have a constant diameter where the gas portholes 33 are formed. Each gas porthole 33 in this case is preferably still located so that the portholes lie adjacent to the gas collection plenum 34 for venting combustion gases directly and radially into the plenum. Accordingly, the annual gas collection plenum 34 may be formed in either the barrel or shroud with equal performance effect and benefit.

It bears noting that the combustion gas entering the gas collection plenum 34 from the barrel gas portholes 33 circulates in a circumferential direction around the entire 360 degree circumference of the barrel within the plenum. This advantageously increases the volume of gas which can be bled off of the barrel when the firearm is fired to minimize felt recoil.

To vent the gas radially from the firearm and transversely to the longitudinal axis LA to atmosphere, one or more gas discharge ports 44 are formed through the upper half of the shroud 40 above longitudinal axis LA from its interior surface to its exterior surface. In one embodiment, a plurality of discharge ports may be provided in which each port is in direct fluid communication with the annular gas collection plenum 34 (see, e.g. FIGS. 3-7). In the non-limiting illustrated embodiment, the ports may be in the form of elongated longitudinal slots. The combustion gas jets through the shroud ports in a generally upwards direction, thereby creating a downwardly acting reaction force that pushes the barrel and shroud assembly down to counterbalance the upwardly acting muzzle rise forces from discharging the firearm.

Figure 7:
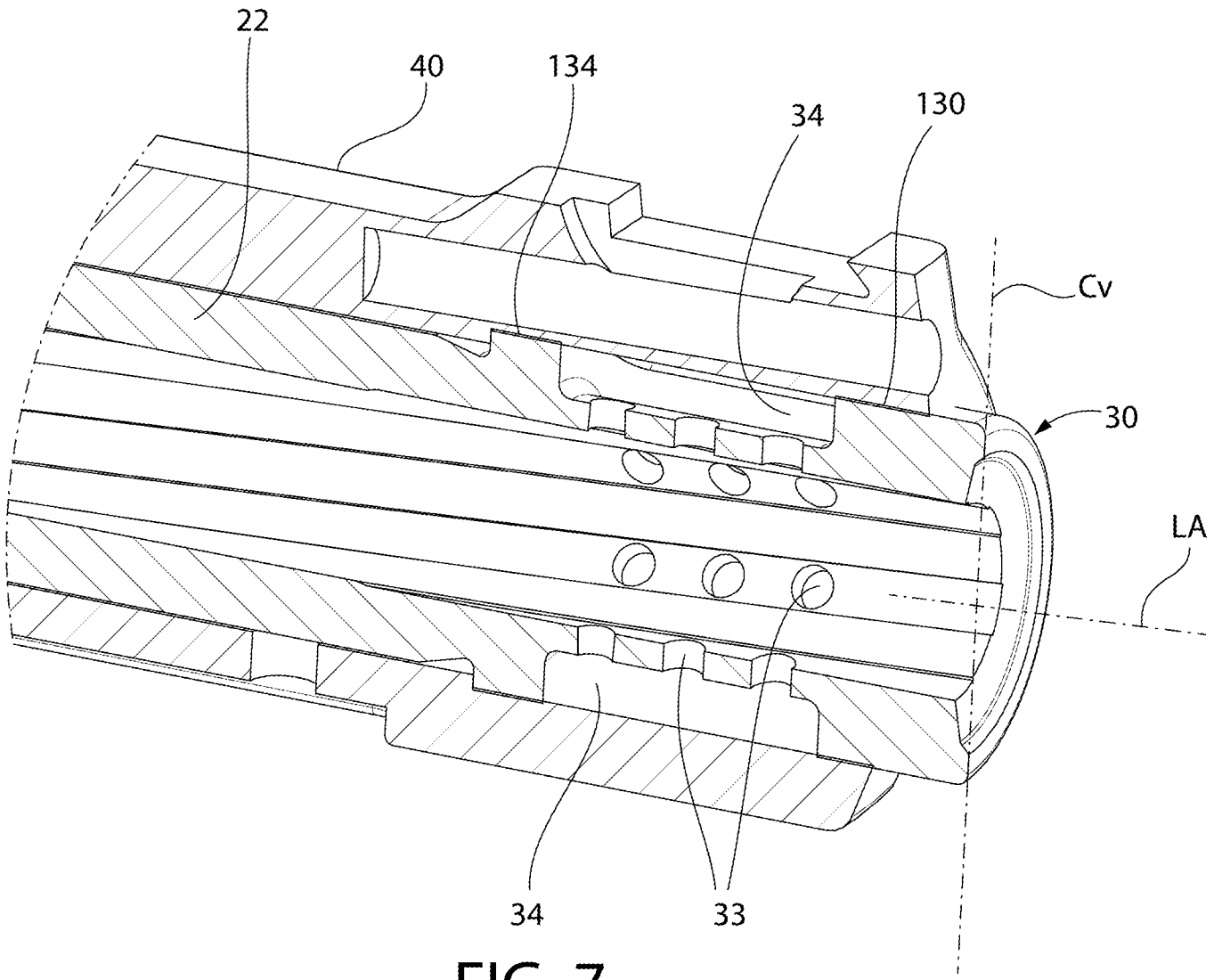
FIG. 7 is a perspective view thereof.
Figure 8:
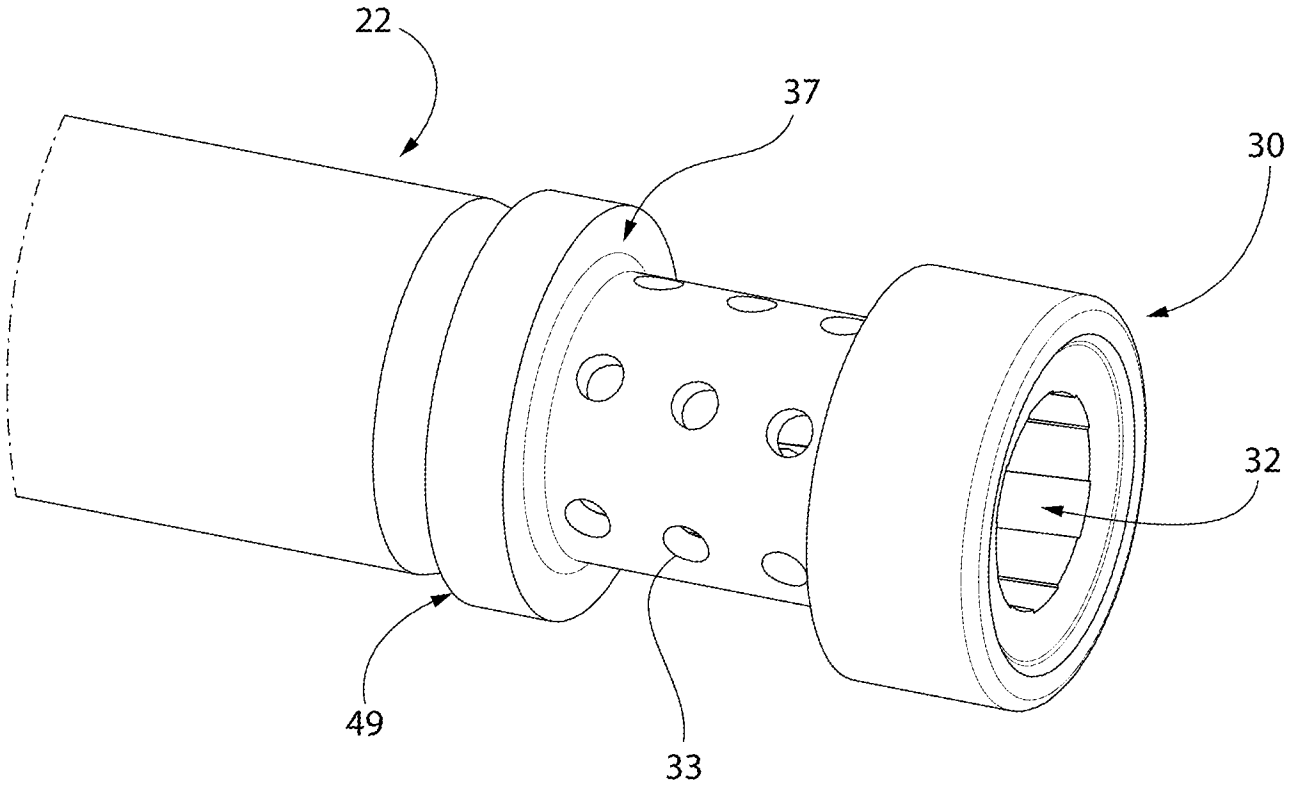
FIG. 8 is a perspective view of the muzzle end of the barrel with muzzle brake.
Figure 21:
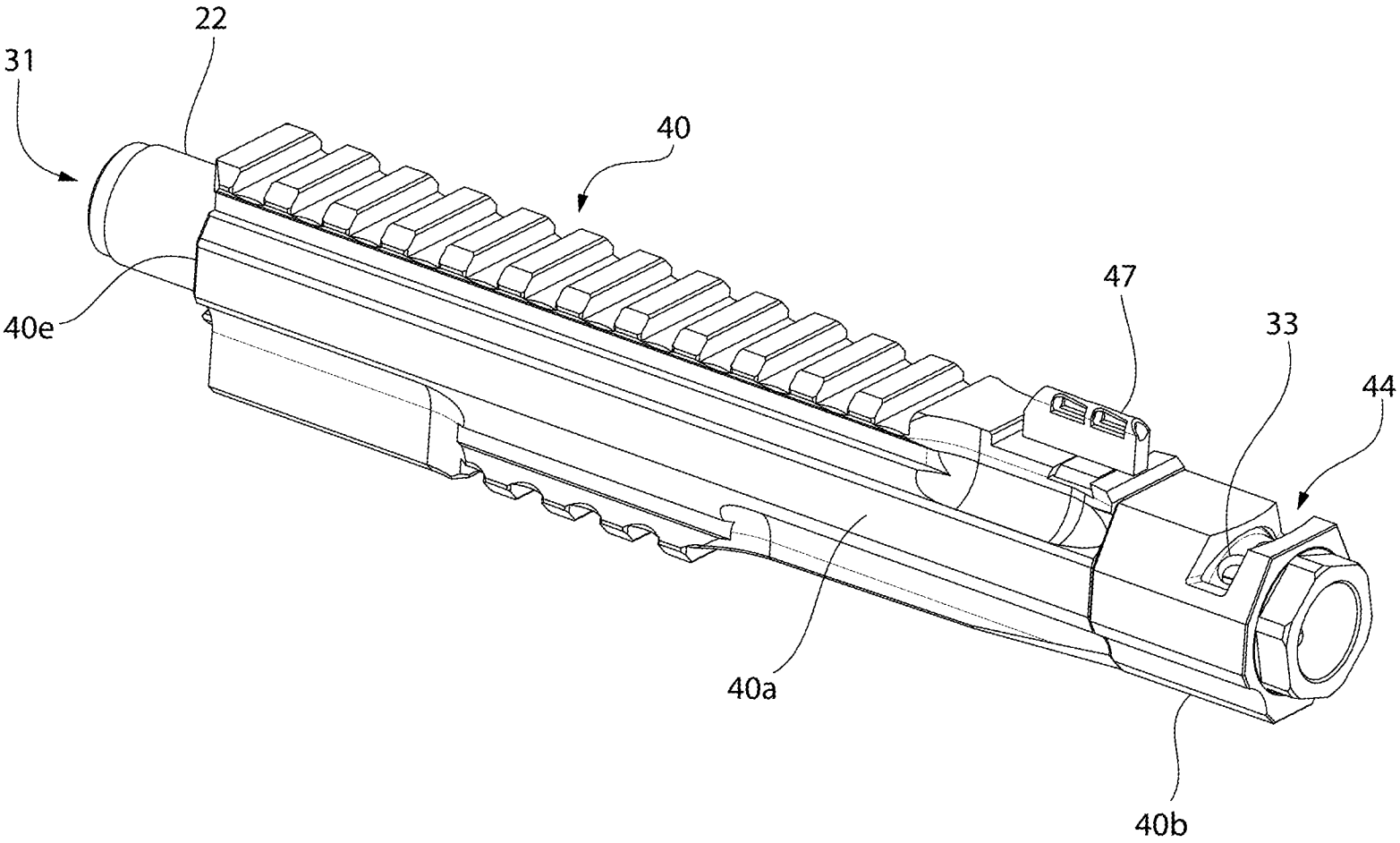
FIG. 21 is a top perspective view of a third embodiment of a barrel porting system with detachable muzzle brake according to the present disclosure.

In the non-limiting illustrated embodiment, a pair of angularly separated discharge ports 44 may be provided in the shroud which are symmetrically arranged around a reference vertical centerline axis Cv of the barrel (see, e.g. FIG. 7). This arrangement is advantageous in that it preserves the ability to mount the front sight directly to the shroud between the ports 44. In some non-limiting embodiments, the centerlines of discharge ports 44 may be angularly separated from each other by an angle of about and including 60 to 90 degrees as shown in FIG. 4B (when viewing the shroud from the muzzle end 30 of the barrel 22 looking rearward). Accordingly, a radial centerline Rc extending through each discharge port 44 which originates at the longitudinal axis LA may be angled at angle A1 between about and including 30 to 45 degrees to the vertical centerline axis Cv of the barrel (shown in FIG. 4B). Other angular orientations may be used; however, the discharge ports should preferably located on only the top half of the barrel shroud for countering muzzle rise. In other possible embodiments, an enlarged single gas discharge port in the form of a longitudinal elongated slot may be disposed on top dead center of the shroud which is in direct fluid communication with the annular gas collection plenum 34. If the front sight is to be mounted on the shroud, the single longitudinal gas discharge port may be positioned rearward of the sight or forward of the sight (analogous to FIG. 21). In yet other possible embodiments, a single laterally elongated discharge port 44 may be used as shown in the embodiment of FIG. 21.

To facilitate assembling the barrel to the shroud, an annular barrel stop shoulder 48 may be formed on the interior surface of the shroud 40 within the longitudinal cavity which abuttingly engages a mating annular stepped shoulder 49 on the exterior surface of the barrel when the barrel is inserted rearwardly into the shroud (see, e.g. FIG. 6). The shoulder 49 may be created by an annular protrusion on the barrel 22 as shown. In one embodiment, the barrel stop shoulder location may be selected so that the front muzzle end of the barrel is positioned at the desired location relative to the shroud. The muzzle end may protrude slightly forward from the shroud in one embodiment. To assemble the barrel and shroud, the barrel 22 is simply inserted into the shroud until the barrel shoulder 49 and corresponding shroud shoulder 48 abut each other. This ensures proper insertion depth of the barrel shroud into the shroud. In one embodiment as shown, the muzzle end 30 of barrel 22 may protrude slightly forward from the shroud 40.

In operation, after firing the firearm, combustion gas released by the cartridge detonation travels longitudinally down the barrel bore 32 forward to and out of the muzzle end 30 following the slug or bullet. A portion of the gas is extracted and flows radially outwards through the gas portholes 33 into annular gas collection plenum 34. Gas is ejected from the entire circumference of the barrel 22 via gas portholes 33 into the plenum. The gas circulates circumferentially 360 degrees through the plenum 34 around the barrel and flows upwards towards the upper gas discharge ports 44 in barrel shroud 40. The collected gas is discharged through the ports to atmosphere. Bleeding some of the gas off through the present barrel porting system advantageously reduces the recoil forces and "felt" recoil experienced by the user. The positioning of the gas discharge ports to eject gas in a generally upward direction further advantageously reduces muzzle rise to improve shooting accuracy, as explained above. Accordingly, the barrel porting system concurrently reduces both recoil and muzzle rise. Due to the array of gas portholes 33 which eject gas a full 360 degrees from the barrel bore within the annular gas collection plenum 34 formed between the barrel 22 and shroud 40, a greater volume of gas may be extracted comparted to conventional muzzle brake designs which improves felt recoil reduction. Directing that greater extracted volume of gas to exit the shroud 44 only through its top discharge ports 44 to atmosphere in turn improves muzzle rise reduction.

In some embodiments when firing cartridges with light powder loads which do not result in as great muzzle rise as higher caliber rounds, additional gas discharge ports may be formed in the shroud at and/or below the longitudinal axis LA in the lower half of the shroud 40 to further reduce felt recoil.

Porting Systems with Detachable Muzzle Brakes

FIGS. 21-25 depict various views of a second embodiment of a barrel porting system according to the present disclosure having a detachable barrel porting system. In this second embodiment, the muzzle brake feature or aspect of the barrel porting system which comprises the array of radial gas portholes is formed (e.g. drilled or otherwise machined) in a discrete detachable porting device which is removably coupled to the muzzle end of the barrel.

The detachable porting device may be a muzzle brake 50 comprising a generally tubular cylindrical body in one embodiment including an open front end 51, an open rear end 52, and a longitudinally-extending internal central passageway 53 extending between and through the ends which forms a path for receiving and discharging the bullet or slug from the barrel bore. The central passageway 53 therefore has a circular cross sectional shape and is concentrically aligned with the barrel bore 32 when the muzzle brake is mounted to the muzzle end 30 of barrel 22.

The detachable muzzle brake comprises the same radial gas portholes 33 previously described herein with respect to the embodiment of FIGS. 3-8, albeit the pattern or arrangement may differ as shown. In one embodiment, the gas portholes 33 in detachable muzzle brake 50 may be arranged in a single circumferentially-extending circular array CA in a circumferentially staggered pattern in which the centerline CL each porthole is vertically and longitudinally offset from each of two adjacent portholes in the array (best shown in FIGS. 21 and 24). The staggered pattern allows more portholes to be tightly packed together while still allowing sufficient spacing between portholes to avoid adversely affecting the structural integrity of the muzzle brake 50 to withstand the higher combustion gas pressure to which it is exploded during firing the firearm. In other arrangements, the centerlines CL may be circumferentially aligned as shown in the embodiment of FIG. 6. In other possible embodiments, a plurality of circular arrays CA may be provided analogously to the embodiment shown in FIG. 6.

The muzzle brake 50 of the detachable barrel porting system in one embodiment further includes enlarged annular circumferentially extending gas collection channel 37 which defines gas collection plenum 34. The channel/plenum extends a full 360 degrees around the exterior and circumference of the detachable muzzle brake 50. In one embodiment, the channel 37 may be recessed into the exterior surface of the muzzle brake body and formed by a reduced diameter intermediate portion of the muzzle brake as shown (best seen in FIGS. 21 and 24). The intermediate portion may therefore have a smaller diameter than the full diameter front and/or rear portions of the brake adjoining the channel as shown. The full diameter portions of the muzzle brake 50 that interface with the interior surface of the shroud 40 form front and rear gas seals 130, 131. Each gas porthole 33 in the muzzle brake 50 is preferably formed within the gas collection channel 37 to discharge gas from the barrel bore exiting through the portholes directly into the collection channel and plenum 34 when the firearm is fired. The gas portholes are therefore in direct fluid communication with the channel. The channel 37 is longitudinally broad having a greater axial length than at least twice its depth, and preferably in some embodiments greater than at least three times its depth. The axial length of the channel may vary depending on the number and longitudinal spacing of the array of gas portholes provided in the muzzle brake so that each porthole is located within and radially vents directly into the channel to minimize pressure drop and maximize the amount of combustion gas extracted from the barrel bore.

In other possible embodiments, the gas collection channel may instead be formed on the interior surface of the shroud 40. In such a construction, each gas porthole 33 is preferably still formed in the barrel so that the portholes lie adjacent to the gas collection channel 37/plenum 34 for venting combustion gases directly and radially into the channel/plenum. The detachable muzzle brake 50 may therefore have a relatively constant outside diameter. Accordingly, the gas collection channel 37 may be formed in either the barrel or shroud with equal performance effect and benefit.

The gas discharge ports 44 in shroud 40 may be in the form of a pair of elongated longitudinal slots arranged on either side of front sight 47, similar to those shown in FIGS. 3-8 previously described herein. The ports are arranged to intersect and receive gas from the gas collection channel 37 and defined plenum 34. The gas discharge slots each have a length at least coextensive with the axial length of the gas collection channel. This ensures minimum resistance to gas flow and pressure drop across the discharge ports which in turn maximizes the volumetric gas flow that can be vented by the barrel porting system to atmosphere each time the firearm is fired. However, in some embodiments the slots may nonetheless have an axial length less than that of the gas collection channel/plenum.

In other possible configurations such as shown in the illustrated embodiment shown in FIGS. 21-25 and presently being described, an enlarged single cross-wise gas discharge port 44 in the form of an elongated slot may be disposed on top dead center of the shroud 40 which is in direct fluid communication with the gas collection channel 37/plenum 34. The single slot the slot may be located forward of front sight as shown, or may be located immediately to the rear of the front sight mounting interface on the shroud in other embodiments not depicted. The slot may extend across the top of the shroud cap and partially downwards along its sides as shown. The slot is still preferably disposed on the upper half of the shroud cap **40*b* to compensate for upward directed muzzle rise forces when the firearm is discharged. Accordingly, at least some of the upper gas portholes formed in the muzzle brake 50** within the gas collection channel/plenum may be exposed and visible through the discharge slot.

Various threaded or unthreaded coupling approaches may be used to detachable couple the separate muzzle brake 50 to the muzzle end 22 of barrel 22. In the illustrated embodiment, the muzzle brake may be threadably coupled to the barrel by providing internal threads on the rear portion of the muzzle brake which engage mating external threads on a portion of the front muzzle end 30 of the barrel (see, e.g. FIGS. 22A and 25). Various unthreaded coupling means are described herein which alternatively may be used.

Figure 22A:
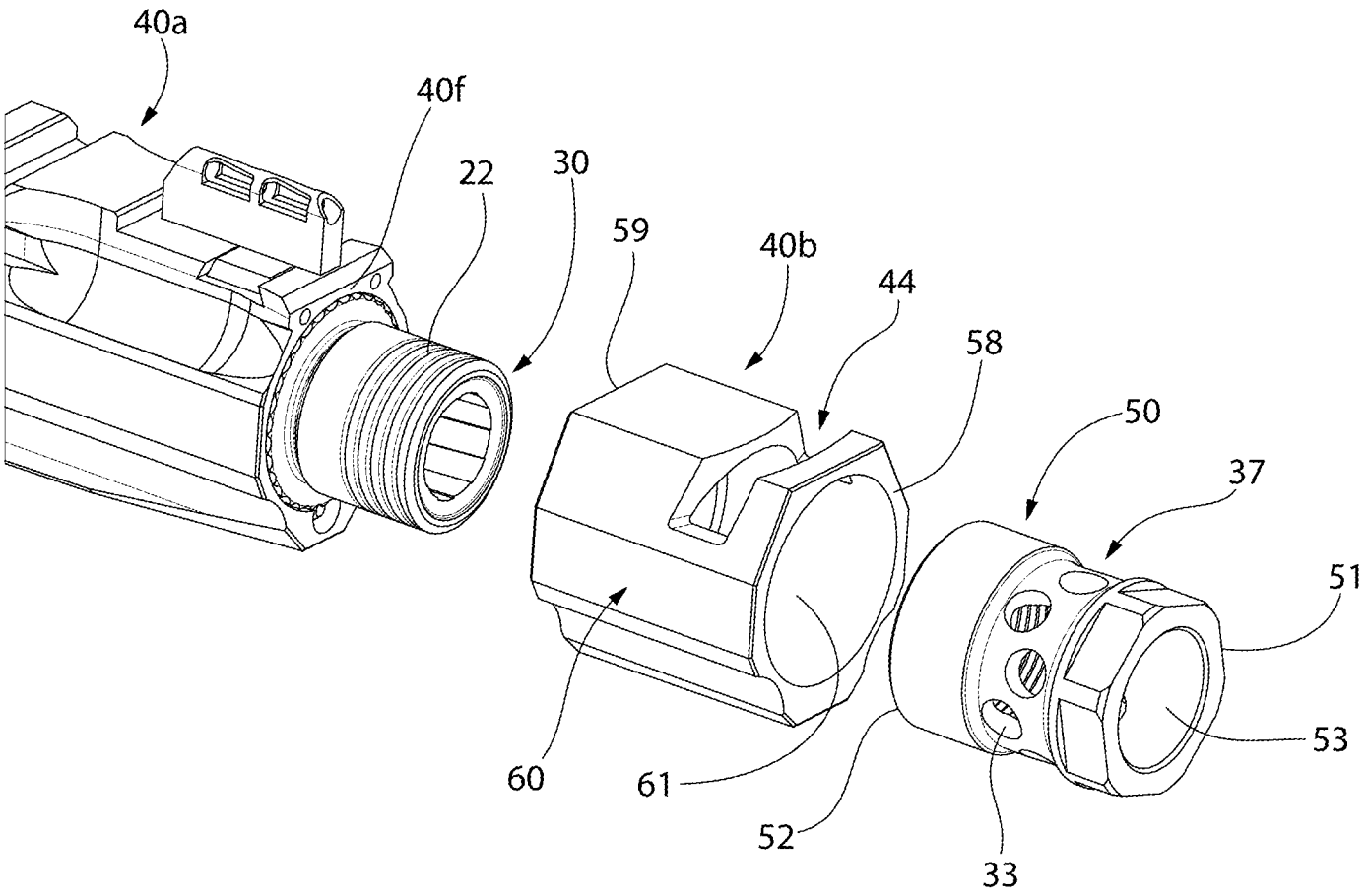
FIG. 22A is a front exploded perspective view thereof.
Figure 22B:
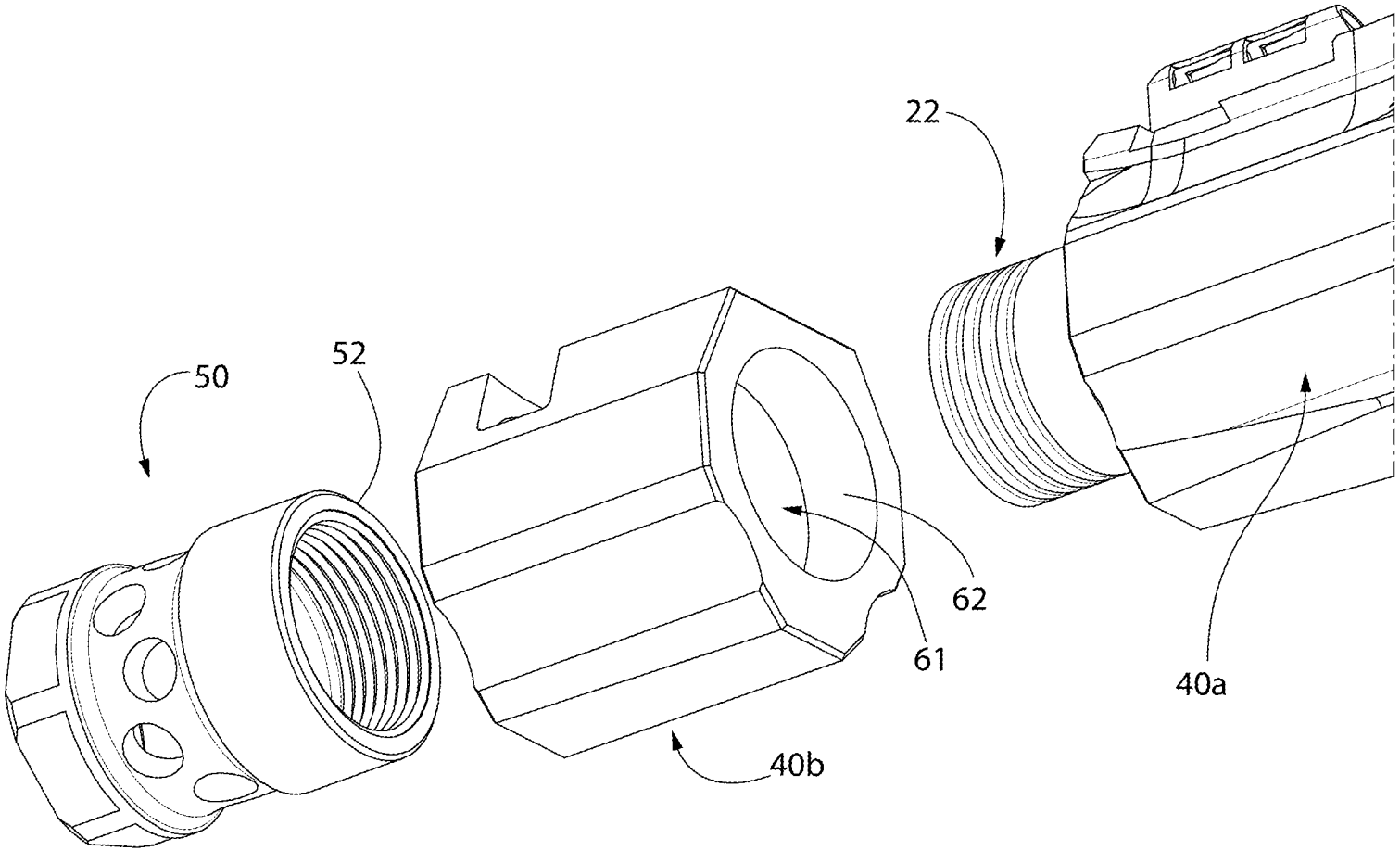
FIG. 22B is a rear exploded perspective view thereof.
Figure 23:
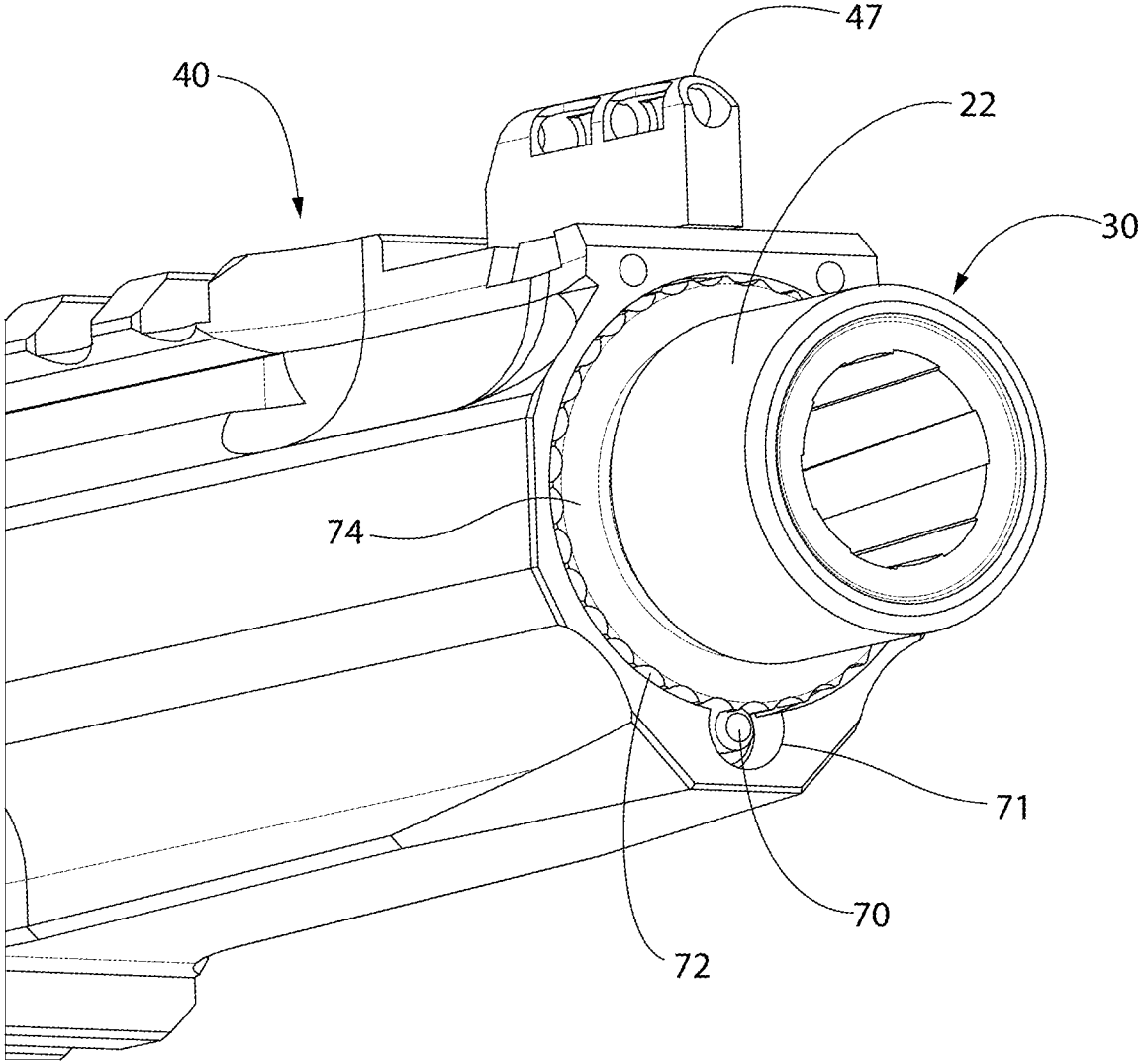
FIG. 23 is an enlarged front perspective view thereof.

There are several additional differences from the fixed barrel porting system of FIGS. 3-8. First, the most notable difference in the present detachable barrel porting system is a two-piece shroud instead of a single-piece monolithic unitary shroud. The two-piece shroud includes a rear shroud portion **40*a* and a removable front shroud portion or cap 40*b* which is configured for easy mounting to and detachment from the firearm to facilitate routine cleaning of the detachable muzzle brake 50 without removing the rear shroud portion. The rear shroud portion is configured for more permanent or semi-permanent securement to the firearm frame which in some embodiments may provide at least partial support to the axially elongated barrel 22. The rear shroud portion 40*a* therefore has an axial (longitudinal) length which extends for a majority of the entire length of the barrel (except for the breech end 31 received in an axial frontal opening of the firearm frame 21 and the distal muzzle end 30. As shown in FIGS. 22 and 23, the muzzle end 30 of barrel 22 may project forwardly from the front end of the rear shroud portion 40***a* for coupling the muzzle brake 50 thereto and to help support and coupled the front shroud cap 40*b* thereto.

The rear shroud portion 40*a* and/or barrel 22 may be mounted to and cantilevered from the front portion of the firearm frame 22 similar to the arrangement shown in FIG. 2. The barrel is nested inside the rear shroud portion 40*b*. The rear breech end 31 of the barrel may be received in a front opening of frame 21 formed by a circular axial bore 55 which extends rearwards into the cylinder opening of the frame, which is open laterally. The axial bore 55 may be threaded in one embodiment to rotatably engage external threads on the barrel rear breech end 31. Other types of unthreaded coupling arrangements between the barrel and frame may be used however. The breech end of the barrel lies adjacent to the cylinder chambers to receive a projectile (e.g. bullet or slug) from the cartridge when detonated during firing. The rear end of the rear shroud portion 40*a* abuttingly engages the front face of the frame 21, and may include a rearwardly extending anti-rotation mounting tab 40*c* at top dead center (FIG. 24) or another location which enters a corresponding forwardly open and complementary configured socket 40*d* (FIG. 2) in the frame 21. This keys the rear shroud portion into proper rotational position on the frame, and prevents the shroud from rotating relative to the frame and barrel. The tab 40*c* may have any suitable polygonal or non-polygonal shape, including for example cylindrical, rectilinear, hexagonal, etc.

Figure 24:
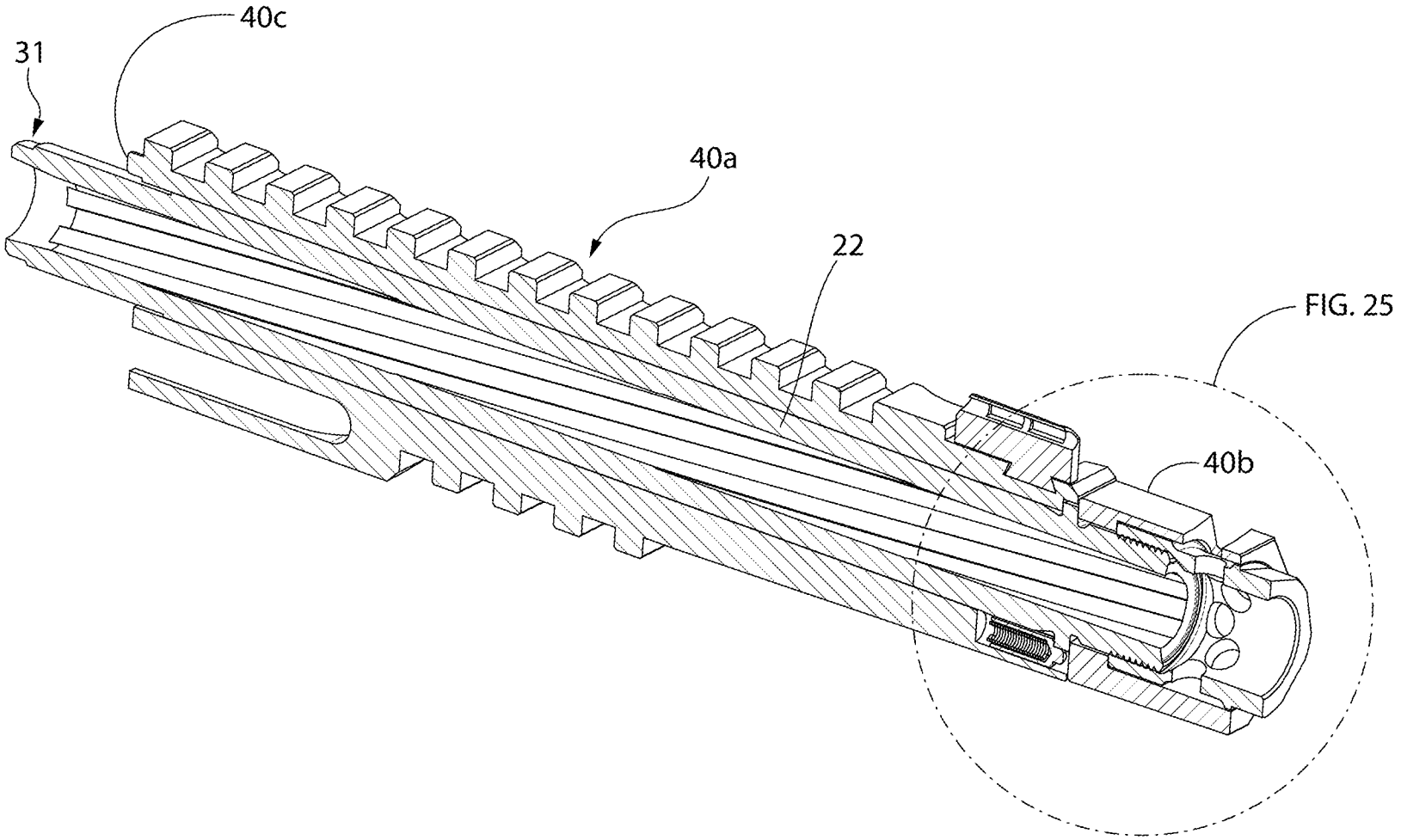
FIG. 24 is a right side cross-sectional perspective view thereof.

In some embodiments, the rear shroud portion 40*a* may be secured in place to the frame 21 by the threaded coupling between the muzzle brake 50 and barrel 22 when the entire shroud and muzzle brake assembly is coupled to the firearm. As shown in FIG. 24, the rear shroud portion 40*a* is trapped between the front face of frame 21 and the rear end of the front shroud cap 40*b*. Other arrangement may be used.

Figure 25:
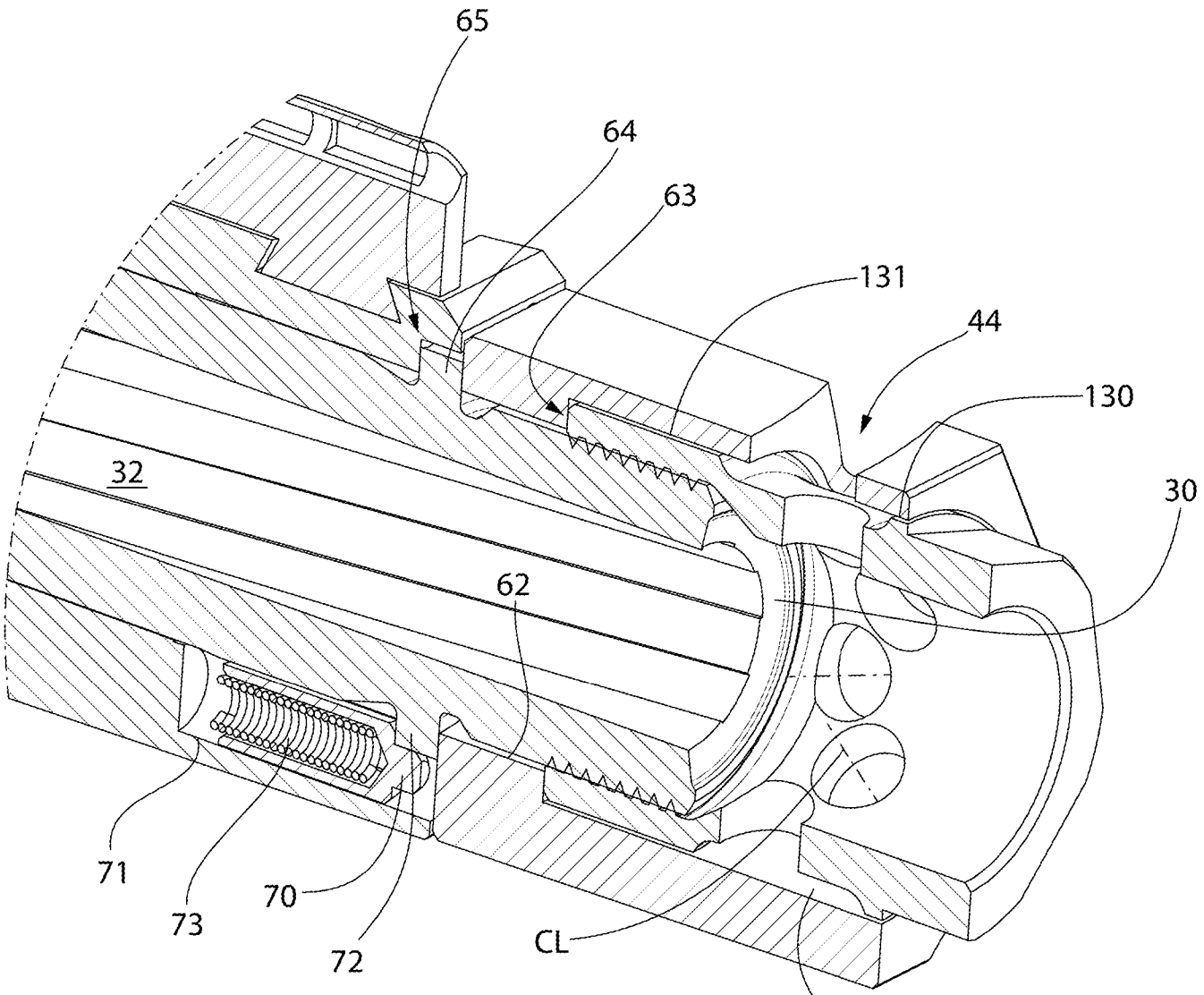
FIG. 25 is an enlarged detail from FIG. 24.

The front shroud cap 40*b* comprises a generally tubular body in one embodiment including an open front end 58, an open rear end 59, sidewalls 60, and an axially extending longitudinal passage 61 between and through the ends for mounting the muzzle brake therein (see, e.g. FIGS. 22 and 24-25). The cap may be polygonal or non-polygon in external configuration or profile and cross-sectional shape. The longitudinal passage 61 may have a cross-sectional shape which is complementary configured to the cross-sectional shape of the muzzle brake (e.g. circular). The shroud cap 40*b* may be complementary configured to the external profile or shape of the rear portion 40*a* of the shroud 40 to provide a uniform and pleasing external appearance. In one embodiment, the external profile of both portions of the shroud may be octagonal; however, other cross-sectional profile shapes may be provided.

The front shroud cap 40*b* includes an internal annular protrusion 62 which projects radially inward into the longitudinal passage of the cap. The protrusion in turn defines an annular mounting shoulder 63 inside the longitudinal passage 61 of the cap proximate to or at its rear end (best shown in FIG. 25). The shoulder 63 defines a forward facing bearing surface which abuttingly engages the rear end 52 of the muzzle brake 50 when mounted to the firearm (see, e.g. FIG. 25). The rear end 59 of the shroud cap 40*b* in turn abuttingly engages an annular protrusion 64 formed on the barrel which in turn abuttingly engages an annular shoulder 65 on the front end of the separate rear portion 40*a* of the shroud 40. When the muzzle brake 50 is threaded onto the threaded front muzzle end 31 of barrel 22, the muzzle brake compresses annular mounting shoulder 63 of front shroud cap 40*b* against the barrel annular protrusion 64, which in turn compresses the rear end of fixed shroud portion 40*a* against the front end of the frame 21 at the rear end of barrel 22. This dual action both secures the rear shroud portion 40*a* and front shroud cap 40*b* to the firearm. Both a portion of the front shroud cap 40*b* and the rear shroud portion 40*a* are thus trapped between the muzzle brake 50 and frame 21.

To couple both the muzzle brake 50 and front shroud cap 40*b* to the firearm, the muzzle end 30 of barrel 22 includes an externally threaded front extension which rotatably engages internal threads formed inside the rear end 52 of muzzle brake.

Figure 9A:
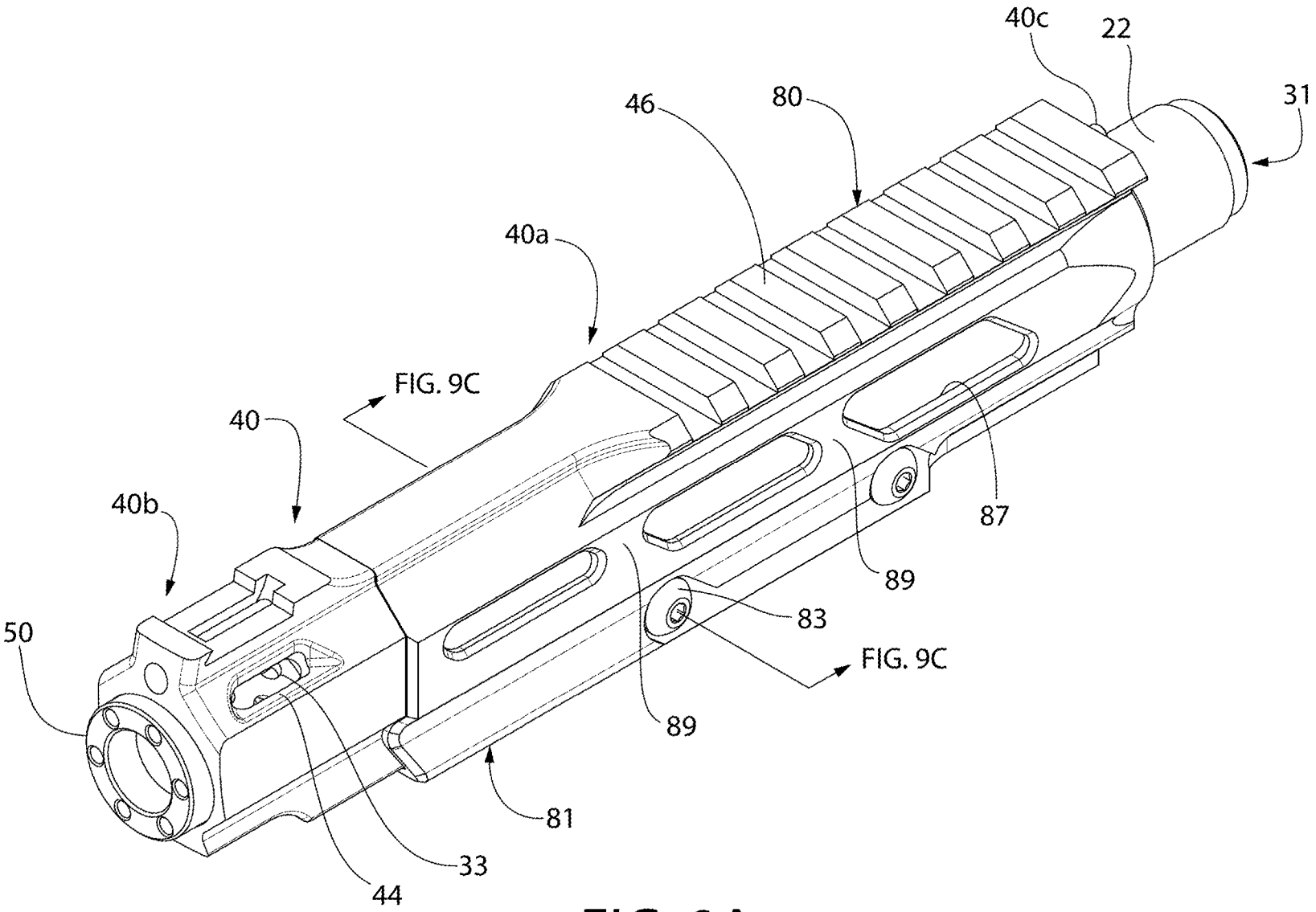
FIG. 9A is a top perspective view of a second embodiment of a barrel porting system with detachable muzzle brake according to the present disclosure.

To assemble the detachable barrel porting system to the firearm, the rear shroud portion 40*a* is first slid rearward over the barrel 22 until rear end 40*e* of shroud portion 40*a* abuttingly engages the front end of frame 21 (see, e.g. FIGS. 2 and 21-25). The rear anti-rotation mounting tab 40*c* at top dead center (FIG. 24) enters corresponding forwardly open socket 40*d* in frame 21. Next, the process continues by sliding the front shroud cap 40*b* rearward over the threaded front muzzle end extension of the barrel until the cap abuttingly engages the annular protrusion 64 of the barrel 22. Next, the muzzle brake is inserted through the open front end 58 of the shroud cap and threaded onto the front extension of the barrel. As the muzzle brake is rotated and tightened, the rear end of the muzzle brake abuttingly engages the annular mounting shoulder 63 inside of the shroud cap 40*b* as previously described herein, thereby forcing it rearward to increase engagement with the rear fixed portion 40*a* of the shroud 40. The internal annular protrusion 62 of the shroud cap which defines mounting shoulder 63 is trapped between the rear end of the muzzle brake and the barrel annular protrusion 64, and in some embodiments as shown in FIG. 25 also the front end 40*f* of the rear shroud portion 40*a*, thereby locking the shroud cap in place. Once the shroud cap and muzzle brake are installed, the longitudinal passage of the front shroud cap 40*b* and central passageway 53 of the muzzle brake 50 are concentrically and axially aligned with the barrel bore 32 (and longitudinal axis LA defined by the bore centerline). The central passageway of the muzzle brake creates a contiguous projectile passageway with the barrel bore (see, e.g. FIG. 9).

As shown in FIG. 25, the front portion of muzzle brake 50 may protrude forward beyond the front end 58 of the front shroud cap 40*b*. The exposed portion of the front shroud cap 40*b* may have a tooling configuration such as hex shaped for engaging a tool (e.g. hex wrench or ratchet socket) for tightening the muzzle brake onto the barrel 22. Other tooling configurations may be used.

The shroud cap and muzzle brake are removed from the firearm by simply reversing the foregoing assembly process.

Referring to FIGS. 23 and 25, an optional axially oriented spring-biased anti-rotation plunger 70 may be movably mounted to the front end of the fixed rear shroud portion 40*a* in a forwardly open axial bore 71 of the shroud. The plunger engages a plurality of circumferentially spaced locking teeth 72 which encircle the muzzle end 30 of the barrel 22 immediately rearward of the threaded front extension. Teeth 72 may be formed on an annular protrusion of barrel 22 extending radially outward. The plunger 70 is biased towards by spring 73 and engages one of the plural recesses formed between the teeth 72 to prevent the barrel from rotating relative to the shroud and the frame when the threaded muzzle brake is unscrewed from the muzzle end of the barrel for removal and cleaning. Because the rear end of the fixed rear shroud portion is rotationally locked to the frame as previously described herein, locking the barrel in turn to the rear shroud portion via the anti-rotation plunger prevents the barrel from rotating and unscrewing at its threaded connection to the frame.

It bears noting that unlike conventional muzzle brakes in which the gas vents are entirely exposed to the atmosphere, a majority of the gas portholes in the present muzzle brake portion of the barrel porting system are enclosed and shielded by the outer shroud 40 (other than the few that may be located directly beneath the gas discharge ports 44). This prevents direct release of the gases from many different radial directions as in conventional muzzle brake. Instead, the gases in the present barrel porting system are advantageously controlled and channeled to discharge only through the gas discharge ports in the outer shroud as previously described herein. This maximizes reduction of muzzle rise or lift when firing the firearm, thereby producing greater accuracy and lessening the time required to reacquire the target between shots. In addition, the affects on nearby shooters such as at a firing range or in a shooting competition are minimized by eliminating directly lateral discharge of combustion gases as in many conventional muzzle brakes.

FIGS. 9-20B depict various views of a third embodiment of a barrel porting system according to the present disclosure having a detachable barrel porting system. This third embodiment is similar to and includes many of the same features as the previous detachable muzzle brake system shown in FIGS. 21-25 and described herein. The similarities include a two-piece shroud (front shroud cap 40*b* and rear shroud portion 40*a*), rear anti-rotation mounting tab 40*c* at top dead center of the rear end of rear shroud portion 40*a* which engages the corresponding forwardly open and complementary configured socket 40*d* (FIG. 2) in the frame 21 to rotationally lock the rear shroud portion to the frame, muzzle brake 50 threaded onto the threaded front extension of barrel 22 and including recessed channel 37 which defines the gas collection plenum 34, and the array of radial gas portholes 33 formed in the recessed channel of muzzle brake 50. Accordingly, those details will not be repeated here again for the sake of brevity. The discussion which follows therefore describes some of the different aspects of present third embodiment seen in FIGS. 9-20B.

Figure 20A:
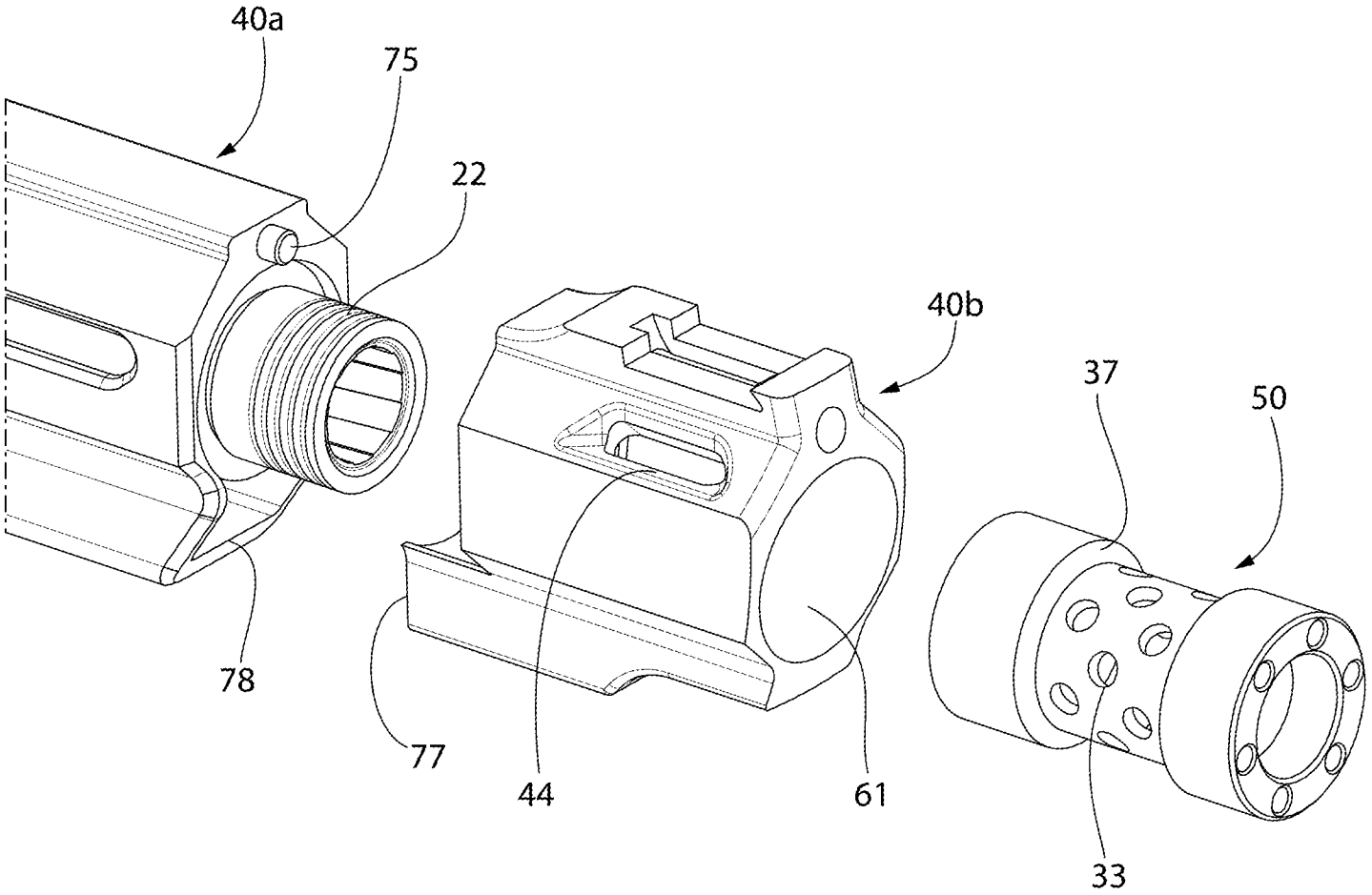
FIG. 20A is an front exploded perspective view of the porting system of FIG. 9A.
Figure 20B:
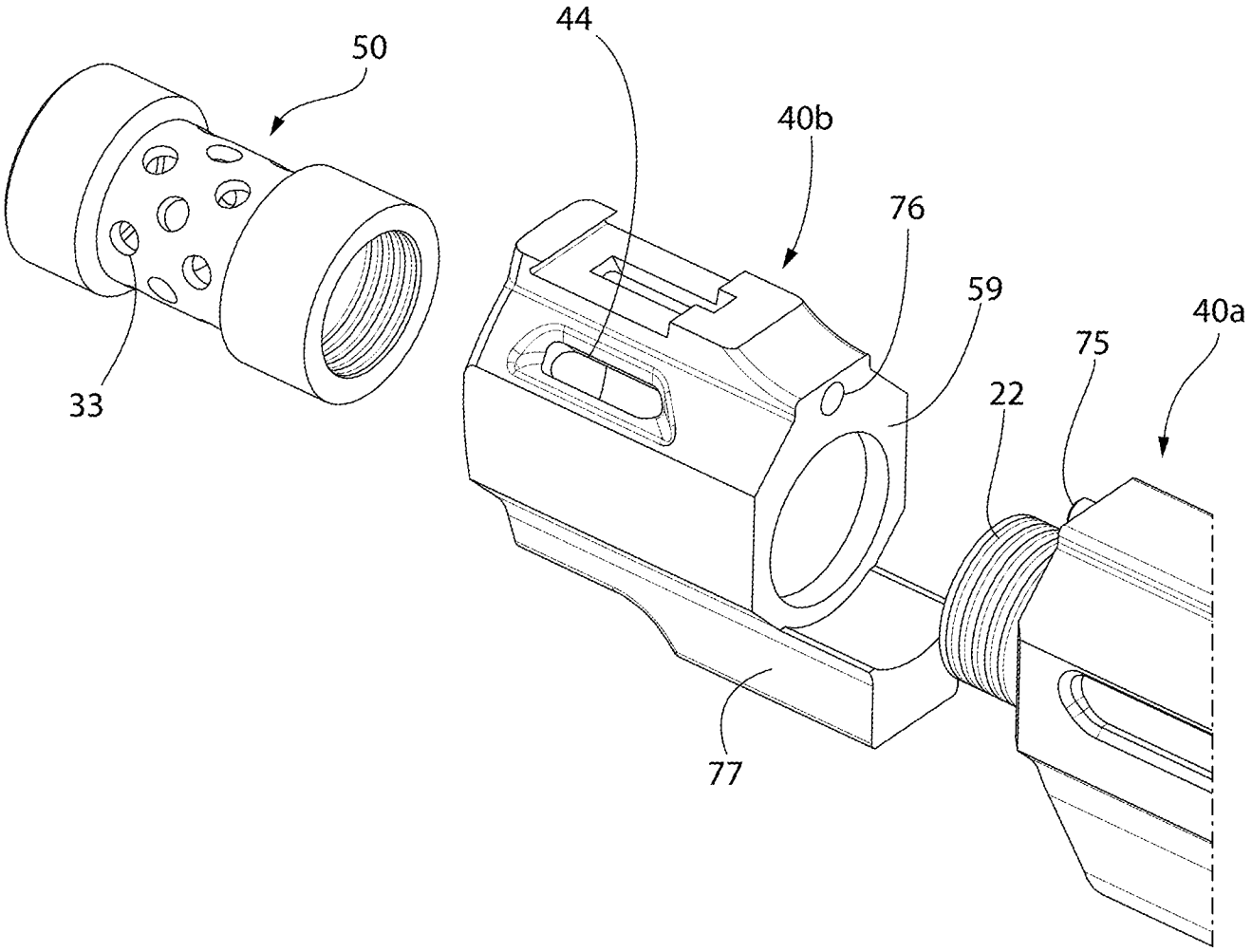
FIG. 20B is a rear exploded perspective view thereof.

Referring to FIGS. 9-20B, the rear shroud portion 40*a* includes a forwardly projecting anti-rotation mounting protrusion 75 received in rearwardly open and complementary configured socket 76 formed in the rear end of front shroud cap 40*b* (see, e.g. FIGS. 20A-B). The protrusion and socket may be formed at top dead center in one embodiment as shown, or another location. The mating anti-rotation protrusion and socket prevent relative rotation between the front shroud cap 40*b* and rear shroud portion 40*a*.

Figure 9B:
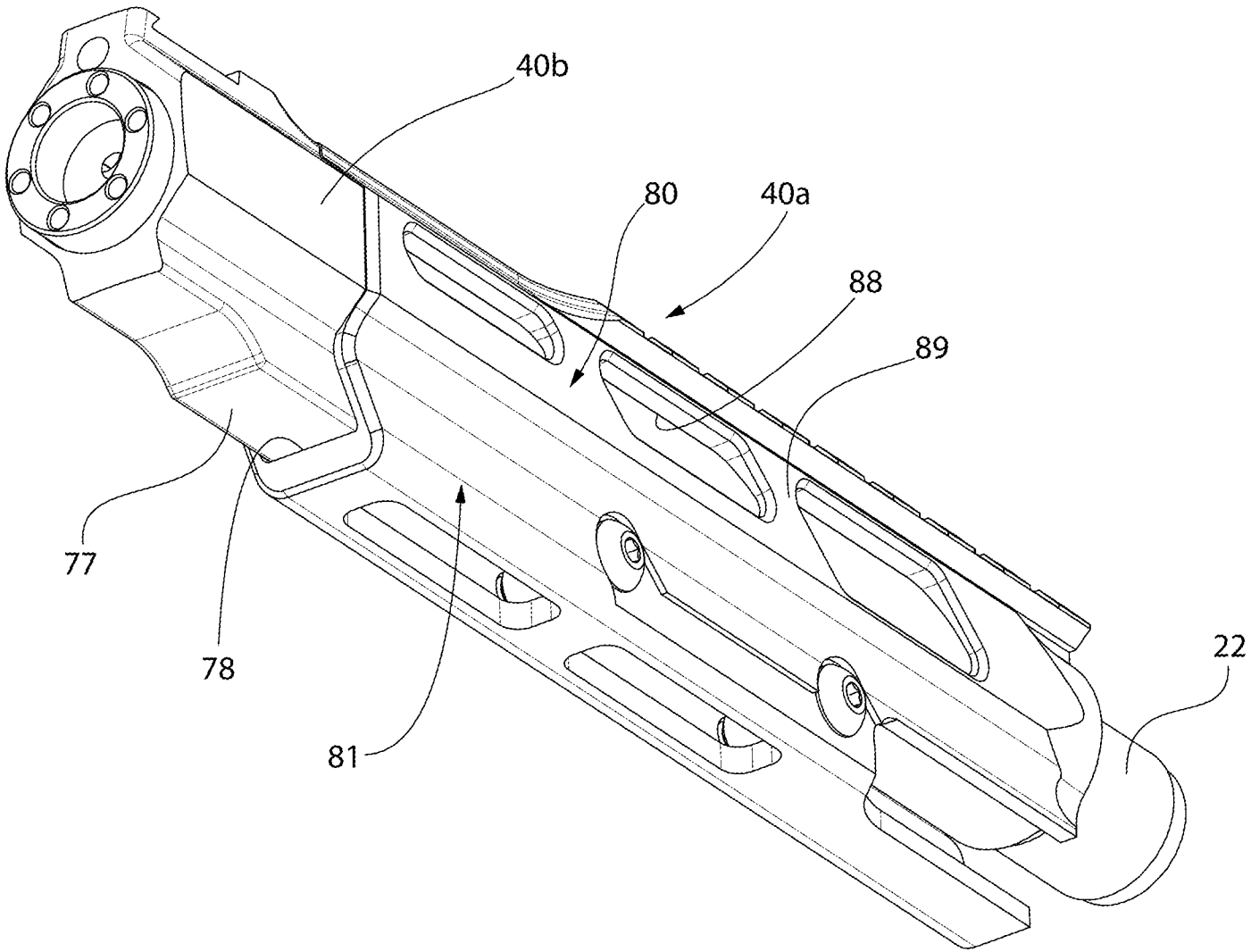
FIG. 9B is a bottom perspective view thereof.

The front shroud cap 40*b* of the third embodiment may further include a rear extension 77 which is received in a forwardly open receptacle 78 of rear shroud portion 40*a* as best shown in FIGS. 9B and 20A-B. Receptacle 78 preferably may be complementary configured to the extension 77 which is laterally broad and may be considered to have a substantially rectilinear cross-sectional shape. In some embodiment, rear extension 77 may have a flat bottom surface and an arcuately curved concave top surface which is complementary configured to the curvature of the barrel 22. When the front shroud cap 40*b* is assembled to rear shroud portion 40*a* by inserting the rear extension 77 into its mating receptacle 78, the rear extension is nested between the barrel 22 and rear shroud portion 40*a* within the receptacle. The rear extension 77 provides a rigid and robust coupling between front shroud cap 40*b* and rear shroud portion 40*a*, which further contributes to prevent relative rotation therebetween.

In the third embodiment, the rear shroud portion 40*a* is configured to be compressible. This allows the shroud portion to clampingly engage the circumference of barrel 22 for adding stability and rigidity to the assemblage to prevent rattling when the firearm is fired. Referring to FIGS. 9-16, the clamping rear shroud portion 40*a* includes an upper section 80 and a contiguously formed lower section 81 extending downwards therefrom. The upper and lower sections are part of a monolithic unitary construction of the rear shroud portion 40*a*. Upper section 80 circumscribes the top and lateral sides of the barrel 22 forming an inverted generally U-shaped structure extending over the top and each lateral side of barrel 22 (best shown in FIGS. 9C and 12-13). The lower section 81 may have a laterally smaller/narrower width than the lateral width of the upper section 80 due to the fact that the width of the upper section is dictated in part by the diameter of the barrel. An inwardly concave and narrow waist or transition section 87 is formed between the upper and lower sections 80, 81.

Figure 9C:
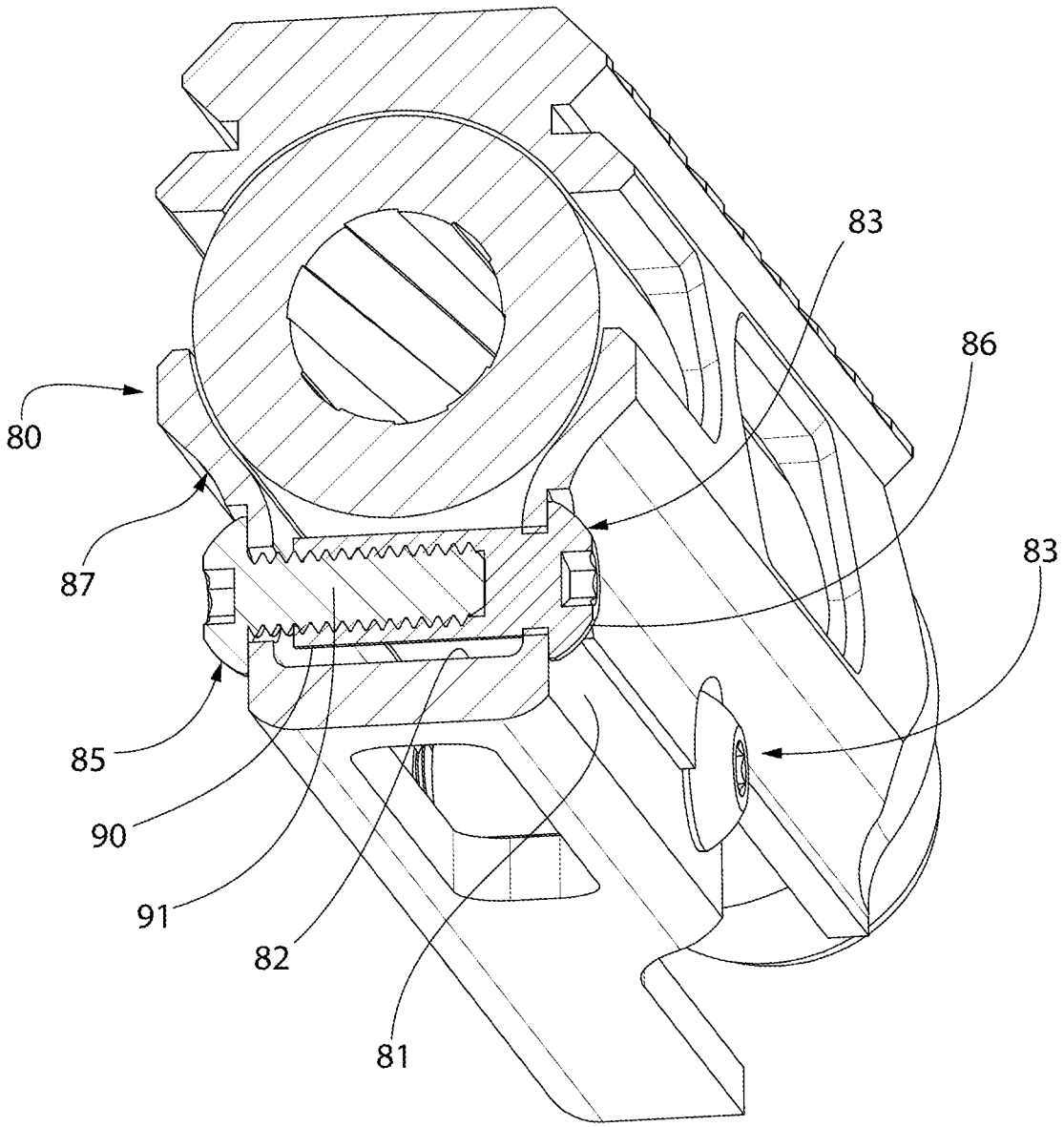
FIG. 9C is a transverse cross sectional view taken from FIG. 9A.
Figure 10:
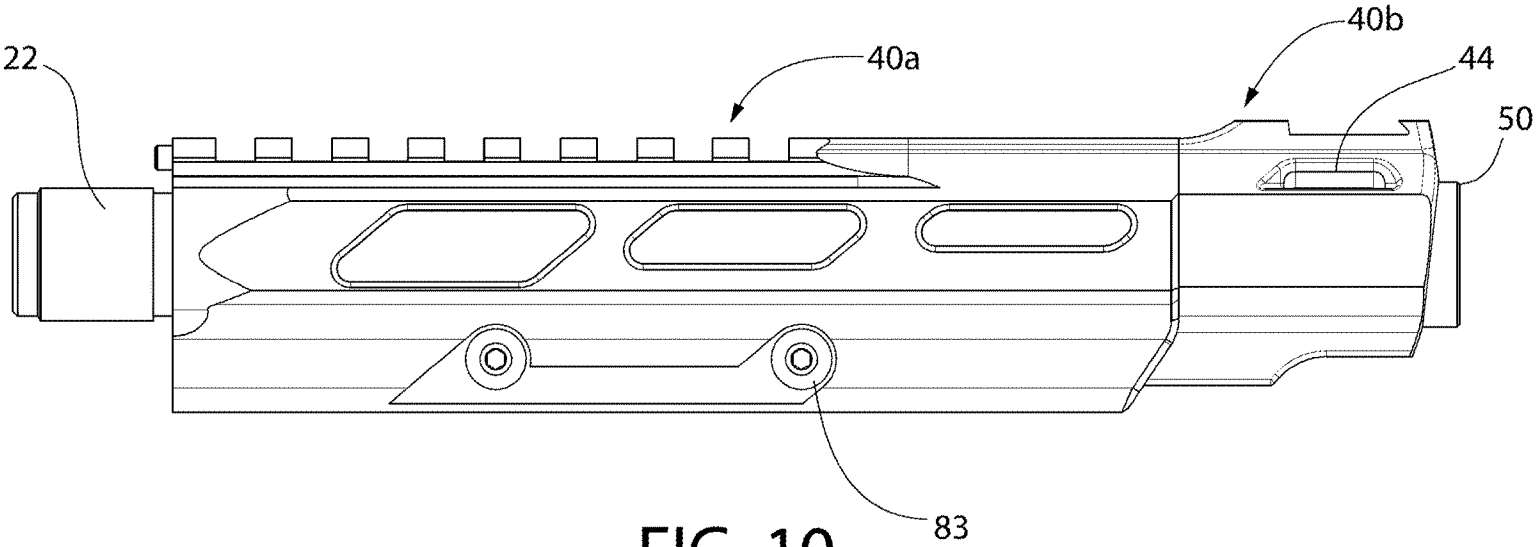
FIG. 10 is a right side view of the firearm of the porting system of FIG. 9A.
Figure 11:
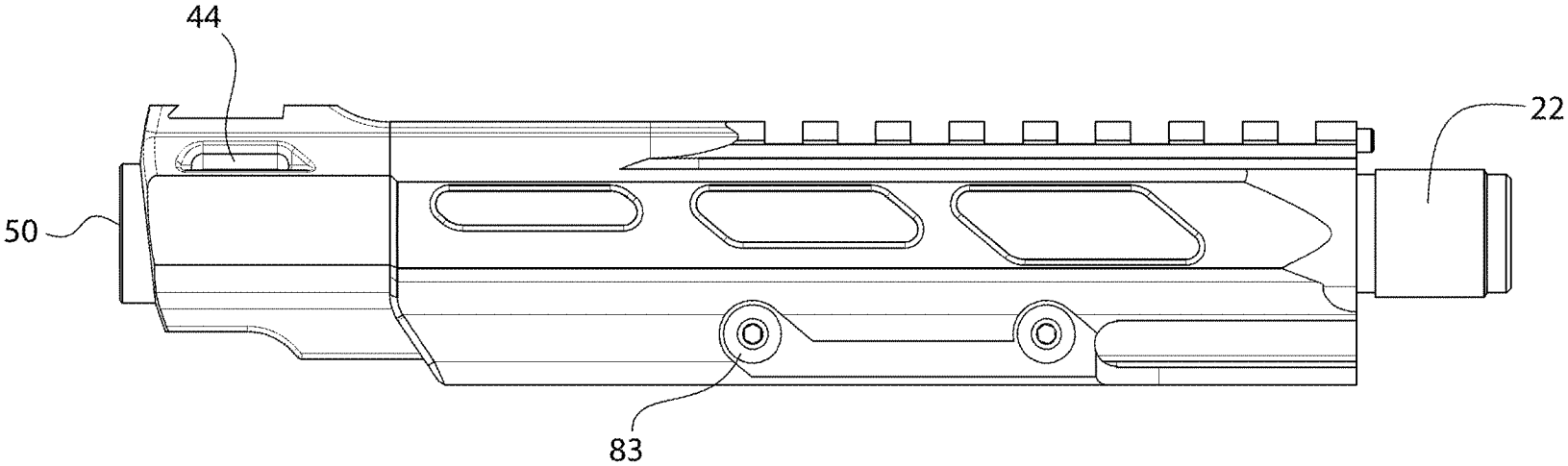
FIG. 11 is a left side view thereof.
Figure 13:
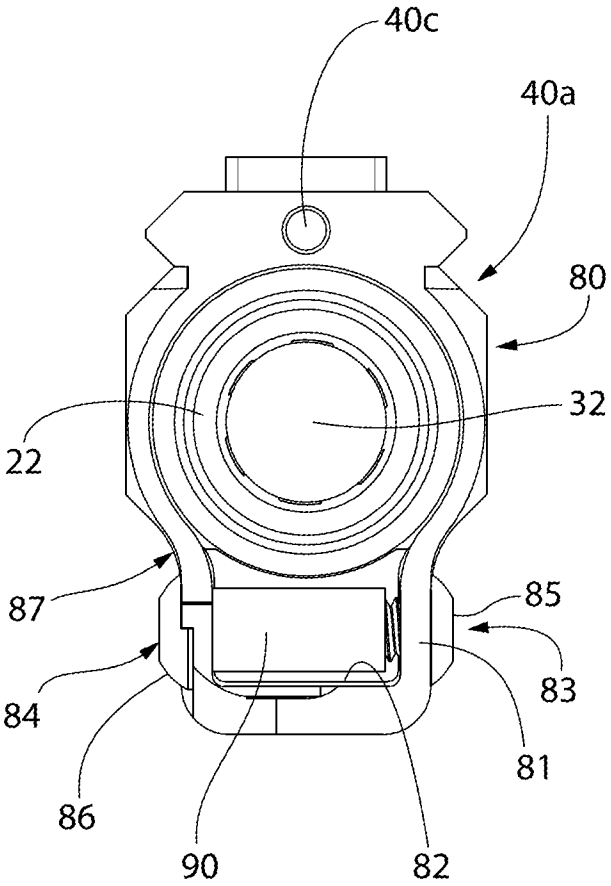
FIG. 13 is a rear view thereof.
Figure 12:
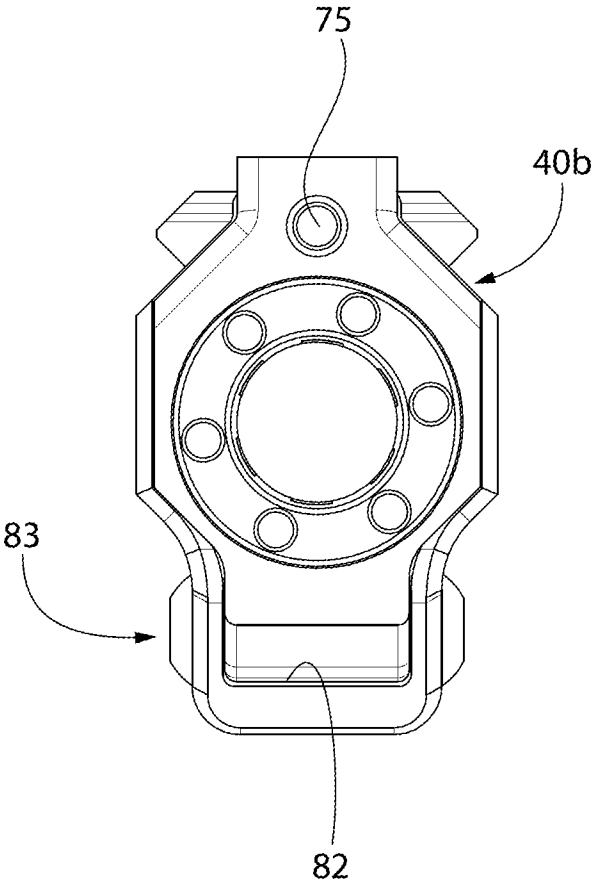
FIG. 12 is a front view thereof.
Figure 14:
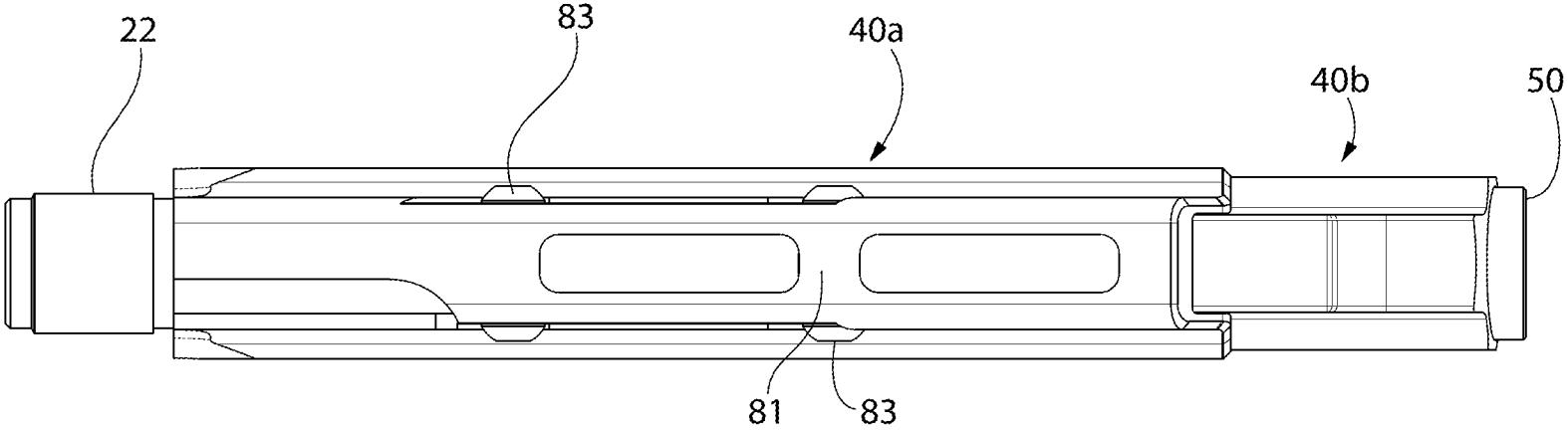
FIG. 14 is bottom view thereof.
Figure 15:
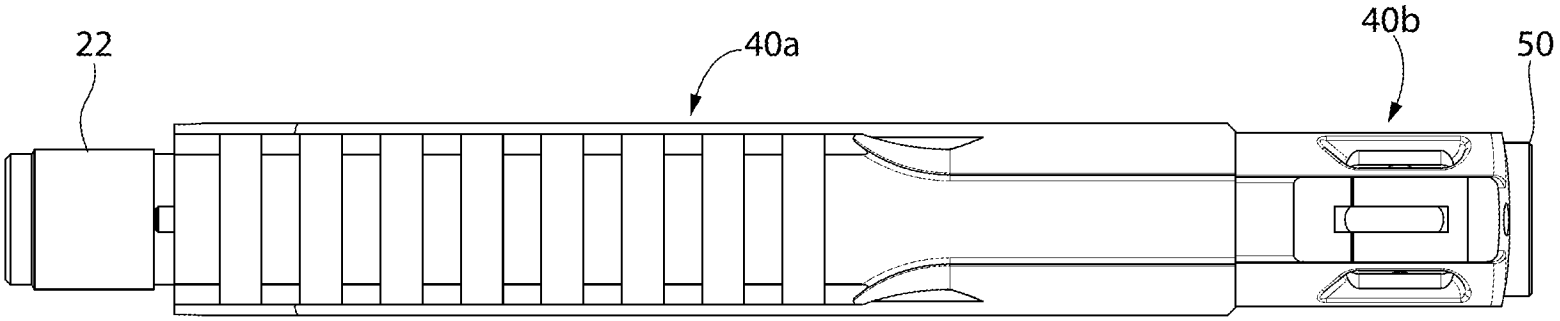
FIG. 15 is a top view thereof.
Figure 16:
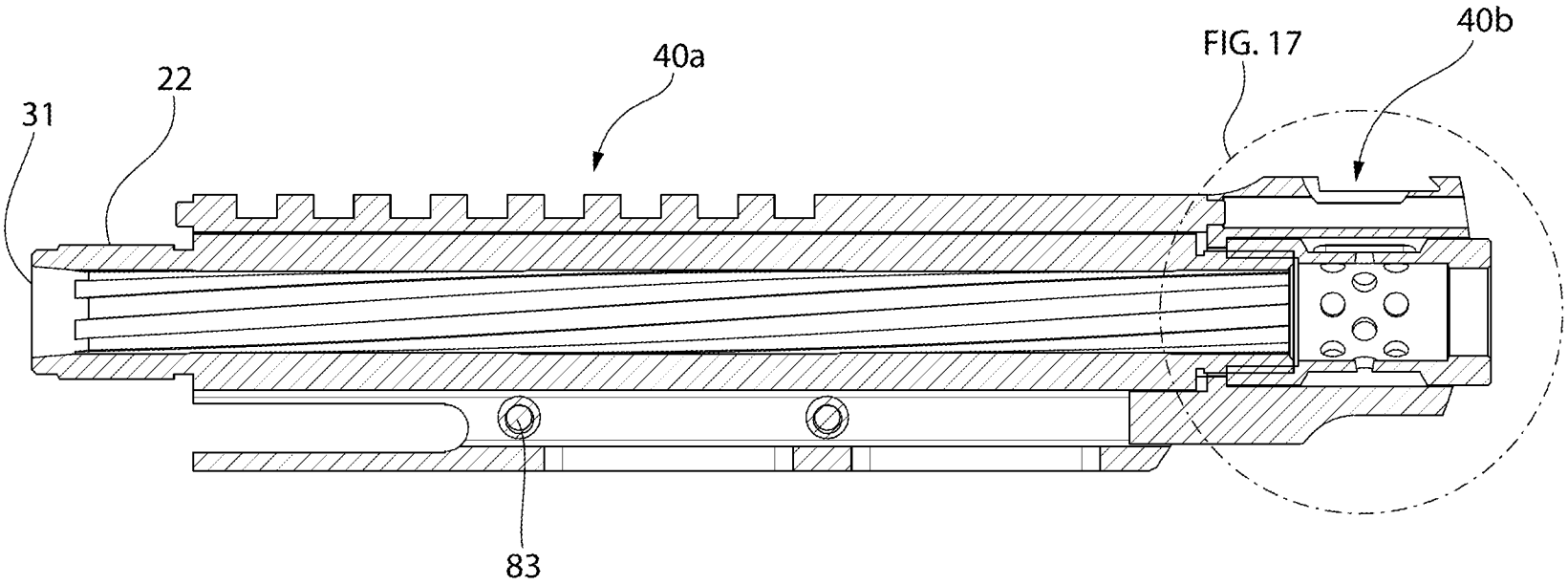
FIG. 16 is a right side cross-sectional view thereof.

With continuing reference to FIGS. 9C and 12-13, the lower section 81 of rear shroud portion 40*a* is disposed and extends beneath barrel 22 for a distance to define a longitudinally-extending open cavity 82 below the barrel when the shroud portion and barrel are assembled. Cavity 82 may extend completely through and penetrates the front and rear ends of rear shroud portion 40*a*. One or more cross bolting assemblies 83 are provided which extend laterally through lower section 81. In the non-limiting illustrated embodiment, a pair of bolting assemblies are provided. Each assembly in one embodiment may comprise a sleeve nut 84 and bolt 85 which are well known in the art. Sleeve nut 84 includes head 86 and integrally formed internally threaded sleeve 90 which is threadably engaged by the threaded shaft 91 of the bolt. Sleeve nut head 86 and the head of bolt 85 are configured to engage a tool for tightening the bolting assemblies 83. The sleeve nut head and bolt head engage opposite lateral sides of the lower section 81 of rear shroud portion 40*a* as shown. The sleeve of the sleeve nut and shaft of the bolt extend through each side and are received in longitudinally-extending cavity 82 of the shroud lower section 81 beneath the barrel 22.

To add flexibility, the upper section 80 of rear shroud portion 40*a* is punctuated by a plurality of laterally open and longitudinally elongated windows 88 on each side. The windows further allow heat to be dissipated from the barrel 22 when firing the firearm and reduces the weight of rear shroud portion 40*a*. The windows 88 are separated from each other by narrow vertical web portions 89 which may have a longitudinal width smaller than the longitudinal width of the windows.

The rear shroud portion 40*a* may be formed of a suitably strong metallic or polymeric material (e.g. glass reinforced nylon or other). The design of the shroud including the foregoing windows/openings provides the desired degree of flexibility to deform the shroud and clampingly engage the barrel when the cross bolting assemblies 83 are tightened. In one embodiment, a suitable light gauge metal such as aluminum may be used for rear shroud portion 40*a*. It bears noting at this point that front shroud cap 40*b* is preferably formed of a suitable metal (e.g. steel, etc.) in the present and other embodiments described herein to better resist erosive wear resulting from the jetting combustion gases to which the cap is exposed.

In use when assembling the shroud, rear shroud portion 40*a* is slid over barrel 22 in the manner previously described herein. The cross bolt assemblies 83 may be in a loosened condition. Once fully rearward engaged with the frame 21, the cross bolting assemblies 83 are tightened which compresses the externally disposed heads of the sleeve nut and bolt against the lateral sides of the lower section of the rear shroud portion 40*a*. This causes the transition sections 87 on each lateral side of rear shroud portion 40*a* to deform and deflect inwards to compressively clamp the upper section 80 firmly onto and against the barrel 22. The natural resiliency and elastic memory of the rear shroud portion 40*a* material will attempt to spring back to its original undeformed state, thereby advantageously keeping the cross bolting assemblies 53 under tension and tightened after repeating firings of the firearm.

It bears noting that the compressive forces also serves to clamp the rear extension 77 of front shroud cap 40*b* into place on rear shroud portion 40*a*.

The detachable muzzle brake 50 in the third embodiment may have a staggered gas porthole 33 pattern as shown in FIGS. 18-20B. This may comprise three circular arrays CA in which the portholes 33 in each array is staggered from those in an adjacent circular array. The present muzzle brake 50 may further include forwardly open tooling features 50*a* which can be engaged by a complementary configured tool for threading or unthreading the muzzle brake onto or from barrel 22. Feature 50*a* may be circular holes in one embodiment as shown or any of the other muzzle brake tooling ends discloses herein. Muzzle brake 50 may protrude forward from the front shroud cap 40*b* as shown (see, e.g. FIG. 17).

FIGS. 27-30 depict various views of a third embodiment of a barrel porting system according to the present disclosure having a detachable barrel porting system. This third embodiment is similar to and includes many of the same features as the previous detachable muzzle brake system shown in FIGS. 21-25 and described herein. The similarities include a two-piece shroud (front shroud cap 40*b* and rear shroud portion 40*a*), rear anti-rotation mounting tab 40*c* at top dead center of the rear end of rear shroud portion 40*a* which engages the corresponding forwardly open and complementary configured socket 40*d* (FIG. 2) in the frame 21 to rotationally lock the rear shroud portion to the frame, muzzle brake 50 threaded onto the threaded front extension of barrel 22 and including recessed channel 37 which defines the gas collection plenum 34, and the array of radial gas portholes 33 formed in the recessed channel of muzzle brake 50. Accordingly, those details will not be repeated here again for the sake of brevity. The discussion which follows therefore describes some of the different aspects of present third embodiment seen in FIGS. 9-20B.

FIGS. 27-30 depict various views of a fourth embodiment of a barrel porting system according to the present disclosure having a detachable barrel porting system. This fourth embodiment is similar to and includes many of the same features as the previous detachable muzzle brake systems shown in FIGS. 9A-20B and 21-25 described herein. Accordingly, similar details and features will not be repeated here again for the sake of brevity. The discussion which follows therefore describes some of the different aspects of present fourth embodiment.

Referring to FIGS. 27-30, one noticeable difference is that shroud 40 is a one-piece monolithic structure of unitary construction in lieu of a two-piece shroud (front shroud cap 40*b* and rear shroud portion 40*a*). The present shroud for the fourth embodiment may be similar to the one-piece shroud 40 shown in FIGS. 1-8 and previously described herein and includes axially-extending open internal longitudinal cavity 45 to slideably receive the barrel 22 therein.

Another noticeable difference is that the present muzzle brake is not threaded onto barrel 22 as in the previous detachable barrel embodiments. Muzzle brake 50 in the fourth embodiment is held in place by a wedge assembly comprising a wedge insert 100 received in a downwardly open wedge cavity 102 formed in the forward portion of the shroud 40. Wedge insert 100 may have a generally block-shaped body including a threaded longitudinal bore 106 which may be extend completely through the body, and an upwardly extending entrapment projection 107. A threaded cylindrical set screw 101 threadably engages the bore 106 and includes a front tooling end configure for engaging a tool, such as a hex screwdriver or key. The wedge insert is held in place inside wedge cavity 102 by a bottom closure plate 109 which may be threadably attached to the shroud 40 in one embodiment via screws 105 engaging threaded holes 104 in the bottom of the shroud. Other ways to removably attach closure plate 109 to the shroud may be used.

To assemble the muzzle brake 50 and wedge assembly to the firearm, the shroud 40 is first inserted over the barrel 22 and slid fully rearward to abuttingly engage firearm frame 21 in the manner previously described herein. Next, the muzzle brake 50 is first inserted through the open front end of the shroud 40 and fully into longitudinal cavity 45 (parallel to longitudinal axis LA) until the rear end 52 of muzzle brake abuttingly engages the radially extending annular protrusion 64 formed on the barrel. The wedge insert 100 is provided with the set screw 101 threaded completely inside the insert. Wedge insert 100 is then inserted from below shroud 40 into the forward-most portion of the wedge cavity 102. Entrapment projection 107 becomes abuttingly engaged with annular shoulder 108 formed on the inside of muzzle brake 50 which defines a forward facing bearing surface which engages the rear bearing surface on the projection (best shown in FIG. 29). The cylindrical set screw 101 is then accessed through a forwardly open tooling hole 110 formed through the front end of shroud 40, and rotated to linearly draw the set screw axially forward so that it emerges from longitudinal bore 106 and project forwards from wedge insert 100. The set screw 101 abuttingly engages the rear face of the front portion of the shroud adjacent hole 110. This engagement locks and stabilizes the wedge insert 100 in the shroud thereby providing rigidity to the assemblage. The plug 101 may be accessed through tooling hole 110 formed through the front end in the shroud. The closure plate 109 is then fastened onto shroud 40 to secure the wedge insert 100 in place. The front muzzle end 31 of the barrel is recessed within the shroud 40 and spaced rearwards from the front end of the shroud by an axial distance suitable to preserve space within the shroud internal longitudinal cavity 45 for mounting the detachable muzzle brake 50 at least partially therein.

Figure 29:
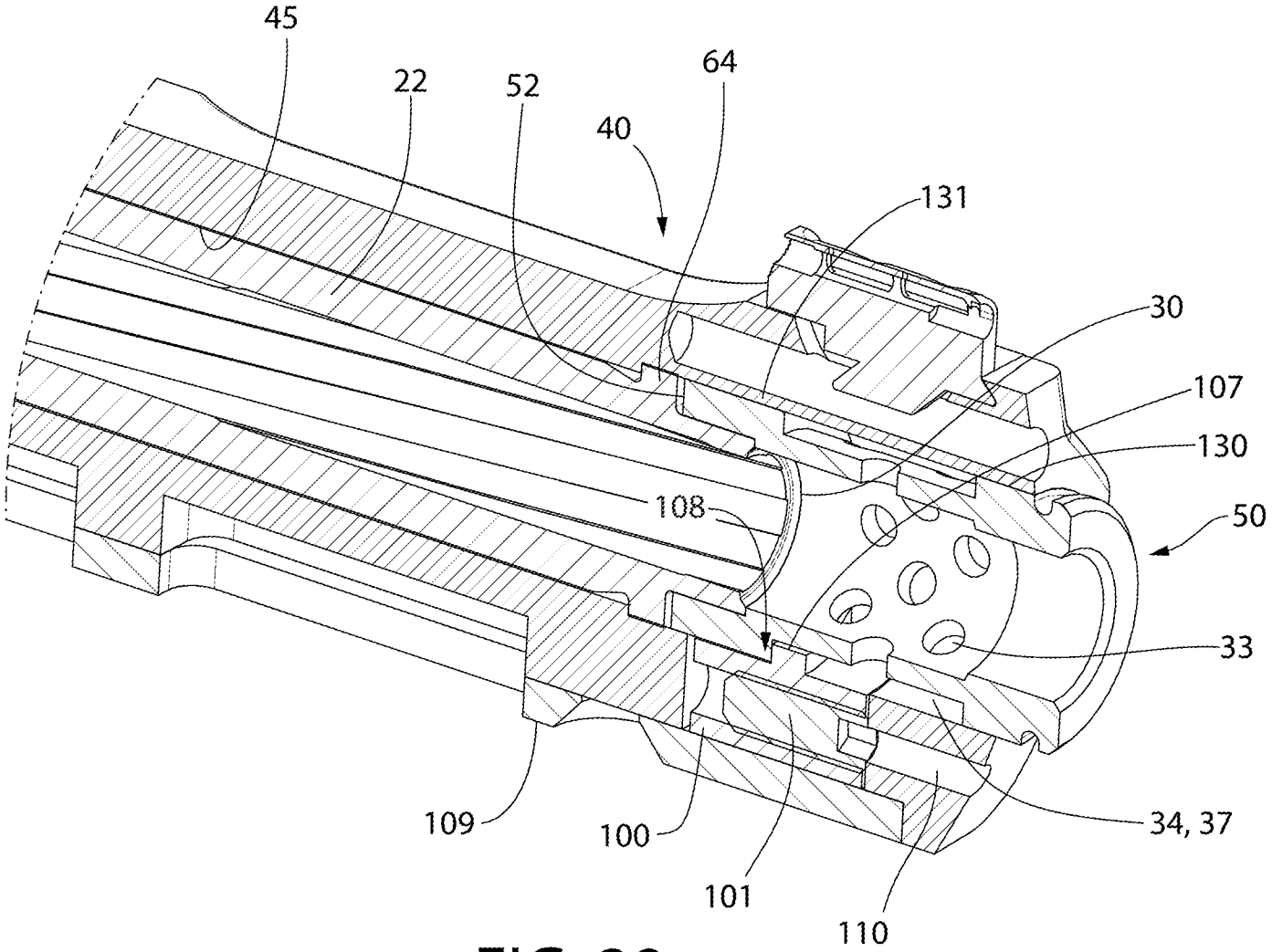
FIG. 29 is an enlarged detail from FIG. 28.
Figure 30:
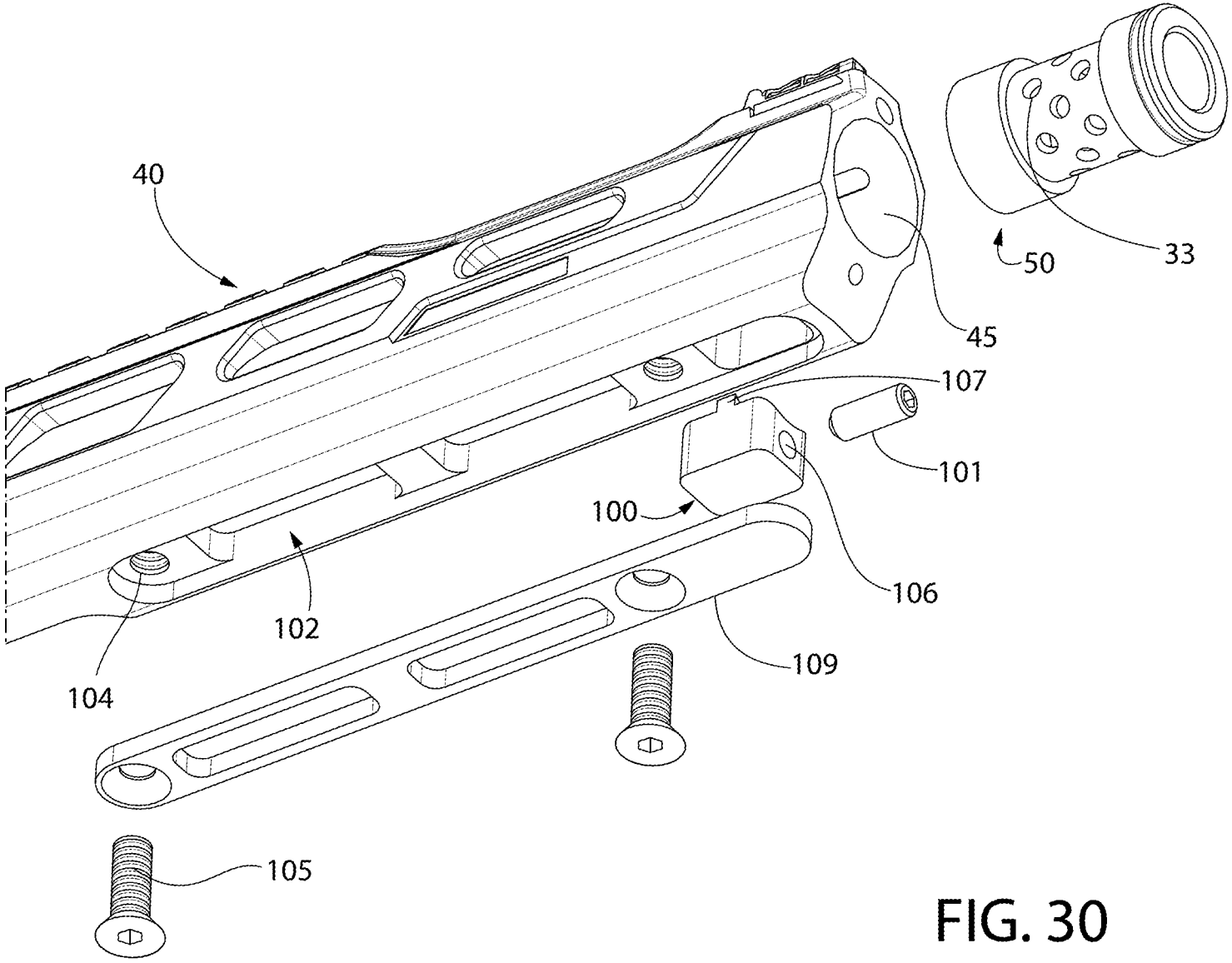
FIG. 30 is an exploded bottom perspective view of the barrel porting system of FIG. 27.

As seen in FIG. 29, in one embodiment the wedge insert entrapment projection 107 may be disposed within the channel 37 and gas collection plenum 34 formed inside the shroud. Accordingly, the top edge of the projection 107 may be arcuately curved to complement the curvature of the muzzle brake body within the channel 37.

Once the wedge insert 100 is in place, the muzzle brake 50 cannot be axially withdrawn forward from the internal longitudinal cavity 45 of the shroud due to blocking and interference between the shroud annular retention surface and the screw. To remove the muzzle brake for cleaning which should be performed regularly as part of responsible firearm maintenance practices, the foregoing process or method steps are simply reversed. To facilitate grasping the distal end of the muzzle brake, the front end of the muzzle brake may protrude slightly forward from the shroud and its internal longitudinal cavity as shown.

Figure 26:
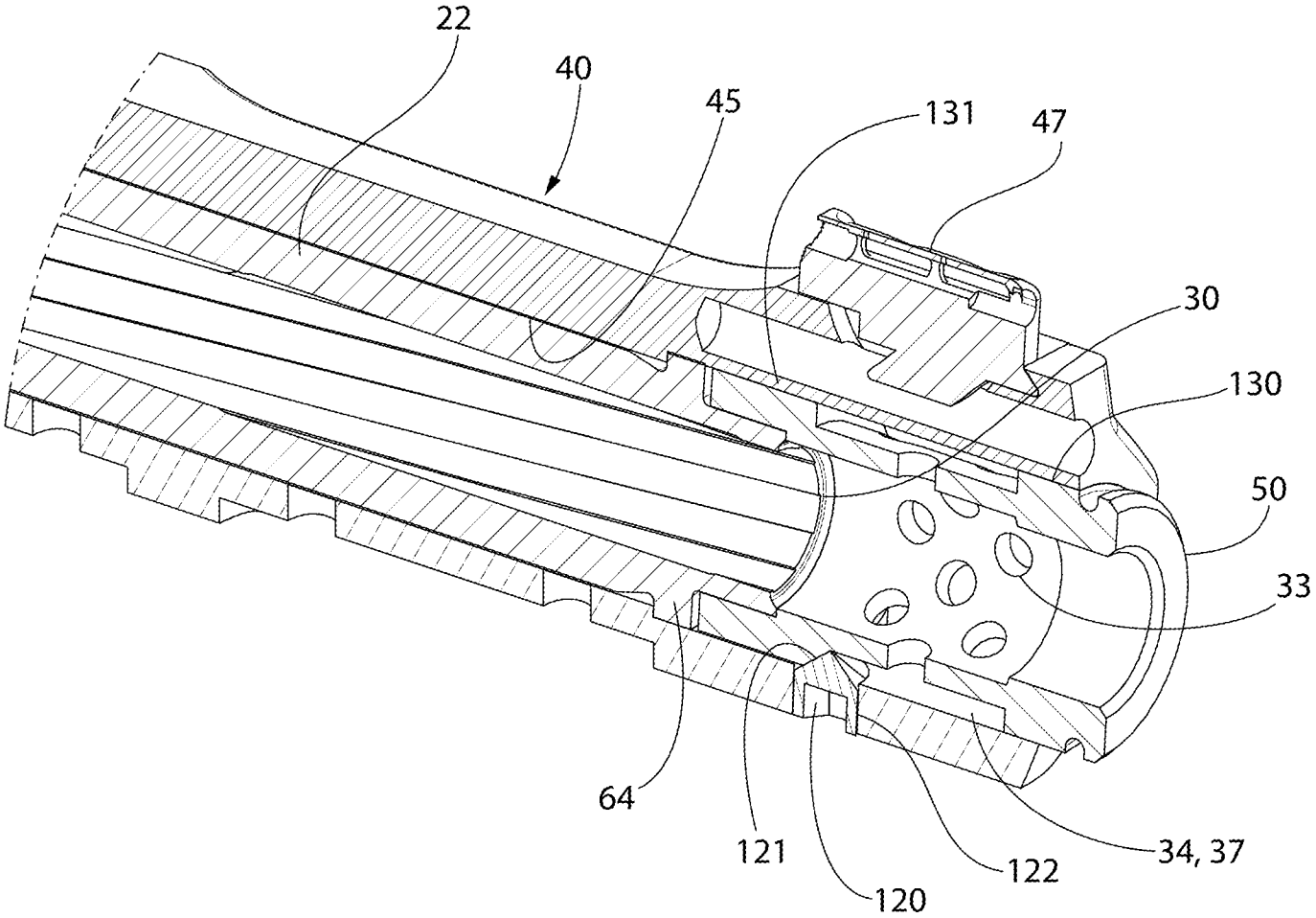
FIG. 26 is a top perspective view of a fourth embodiment of a barrel porting system with detachable muzzle brake according to the present disclosure.
Figure 27:
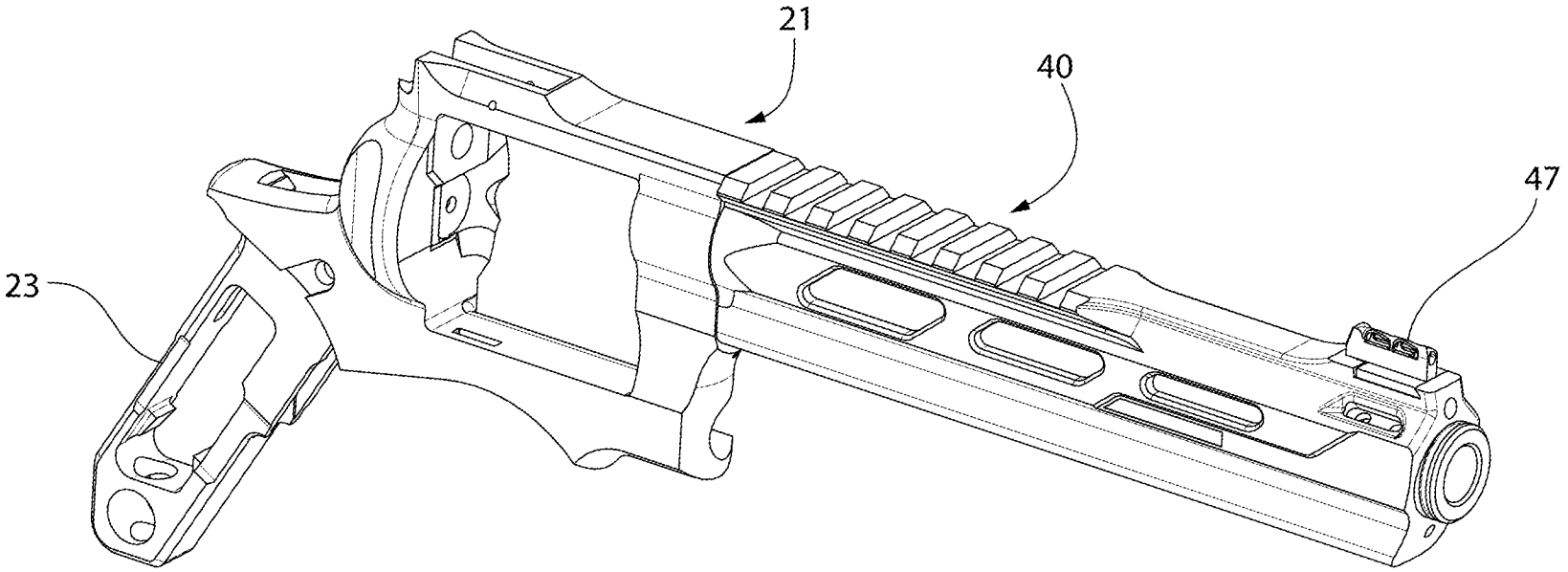
FIG. 27 is a top perspective view of a fifth embodiment of a barrel porting system with detachable muzzle brake according to the present disclosure.
Figure 28:
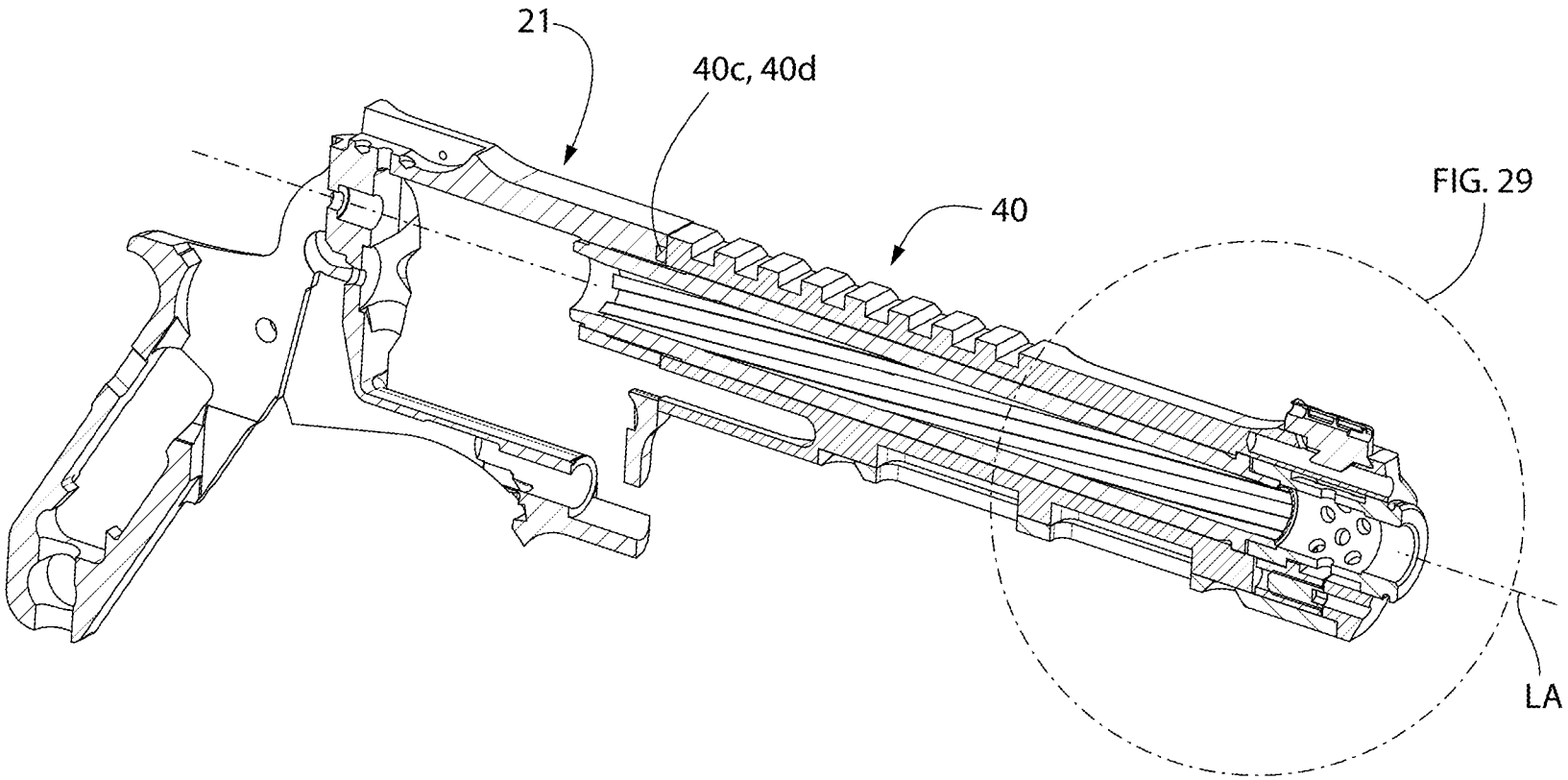
FIG. 28 is a cross sectional view thereof.

FIG. 26 depicts a fifth embodiment of a barrel porting system according to the present disclosure having a detachable barrel porting system. This fifth embodiment is similar to and includes many of the same features as the previous detachable muzzle brake system with single-piece shroud 40 of the fourth embodiment shown in FIGS. 27-30. In this non-limiting embodiment, however, the wedge assembly is replaced by a thread-less muzzle brake coupling system comprises a threaded set screw 120 which acts by wedging action to retain the muzzle brake 50 in the shroud. The set screw engages a threaded transversely open radial bore 122 formed in the bottom of the shroud 40 proximate to its open front end. Set screw 120 includes a proximal head configured to engage a tool (e.g. hex wrench or screwdriver) and a conical distal end which extends transversely through the shroud 40. The screw extends completely through the bottom wall of the shroud 40 into the rear portion of the outward facing circumferential gas collection channel 37/plenum 34 on the exterior surface of the muzzle brake 50. The conical distal end defines an angled wedge-shaped bearing surface which slideably engages a complementary angled annular retention bearing surface 121 which faces forwardly on the muzzle brake. The retention bearing surface 121 is formed at the rear end of the gas collection channel in the muzzle brake in certain embodiments. Both mating bearing surfaces are obliquely angled to the longitudinal axis LA of the barrel bore of the firearm.

To assemble the muzzle brake to the shroud after the barrel 22 already mounted on frame 21 is inserted forward into the internal longitudinal cavity 45 of the shroud 40 in the manner previously described herein, the muzzle brake 50 is inserted rearwardly through the open front end of the shroud until it abuts annular protrusion 64 on barrel 22. The front muzzle end 31 of the barrel is recessed within the shroud 40 and spaced rearwards from the front end of the shroud 40 by an axial distance suitable to preserve space within the shroud internal longitudinal cavity 45 for mounting the detachable muzzle brake 50 at least partially therein as shown.

Once the muzzle brake is fully inserted into the shroud in the foregoing manner, the set screw 120 is fully threaded into its corresponding threaded bore 122 in the shroud 40. The angled annular bearing surface of the set screw distal end and annular retention bearing surface of the muzzle brake 50 engage and slide against each other, thereby producing a wedging action which tends to force the muzzle brake rearward to a greater degree and tighten the mutually engaged surfaces. These mutually engaged surfaces form and advantageously tighten a rear gas seal between the barrel front extension (unthreaded in this embodiment) and the full diameter rear end of the muzzle brake 50. A front gas seal is formed between the full diameter front end of the muzzle brake forward These seals form a substantially gas tight coupling of the muzzle brake to the barrel and shroud.

Once the set screw 120 is in place, the muzzle brake 50 cannot be axially withdrawn forward from the internal longitudinal cavity 45 of the shroud due to blocking and interference between the shroud annular retention surface and the screw. To remove the muzzle brake for cleaning which should be performed regularly as part of responsible firearm maintenance practices, the foregoing process or method steps are simply reversed. To facilitate grasping the distal end of the muzzle brake, the front end of the muzzle brake may protrude slightly forward from the shroud and its internal longitudinal cavity as shown.

While the foregoing description and drawings represent preferred or exemplary ("example") embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A barrel porting system for a firearm comprising: a barrel including a longitudinal axis, a muzzle end, and an axially extending barrel bore which defines a projectile pathway; a detachable porting device removably coupled to the barrel, the porting device comprising a plurality of gas portholes in fluid communication with the barrel bore; an elongated outer shroud encircling the porting device, the shroud including at least one gas discharge port arranged to vent combustion gas from firing the firearm in an outwards direction; and an annular gas collection plenum formed between the shroud and porting device, the plenum configured to collect gas from the gas portholes and discharge the gas through the at least one discharge port in the shroud; wherein the shroud comprises a rear shroud portion and a front shroud cap detachably mounted to the rear shroud portion, and wherein the at least one discharge port is formed in the front shroud cap, wherein the rear shroud portion extends the majority of the length of the barrel.

2. The barrel porting system according to claim 1, wherein the porting device comprises a cylindrical tubular body defining a longitudinally-extending internal central passageway concentrically aligned with the barrel bore.

3. The barrel porting system according to claim 1, wherein the gas collection plenum extends around an entire circumference of the porting device.

4. The barrel porting system according to claim 3, wherein the plenum is defined by a circumferentially-extending annular channel recessed into an exterior surface of the porting device and formed by a reduced diameter portion thereof.

5. The barrel porting system according to claim 1, wherein the gas portholes are arranged in a 360 degree pattern around an entire circumference of the porting device.

6. The barrel porting system according to claim 5, wherein the gas portholes are formed on the porting device within the plenum to discharge gas from the barrel bore directly into the plenum.

7. The barrel porting system according to claim 1, wherein the gas portholes have a circular shape.

8. The barrel porting system according to claim 5, wherein the gas portholes are uniformly spaced apart circumferentially and longitudinally.

9. The barrel porting system according to claim 8, wherein the portholes are arranged in longitudinally spaced apart circular arrays around a circumference of the porting device.

10. The barrel porting system according to claim 9, wherein the portholes in each circular array are circumferentially staggered in location from the portholes in each adjacent circular array.

11. The barrel porting system according to claim 1, wherein the porting device is secured to the muzzle end of the barrel by a thread-less coupling mechanism.

12. A barrel porting system for a firearm comprising:

a barrel including a longitudinal axis, a muzzle end, and an axially extending barrel bore which defines a projectile pathway;

a detachable porting device removably coupled to the barrel, the porting device comprising a plurality of gas portholes in fluid communication with the barrel bore;

an elongated outer shroud encircling the porting device, the shroud including at least one gas discharge port arranged to vent combustion gas from firing the firearm in an outwards direction; and an annular gas collection plenum formed between the shroud and porting device, the plenum configured to collect gas from the gas portholes and discharge the gas through the at least one discharge port in the shroud wherein the porting device is secured to the muzzle end of the barrel by a thread- less coupling mechanism;

wherein the coupling mechanism comprises a transversely oriented set screw having a conical distal end engaging a complementary angled annular retention bearing surface on the porting device which creates a wedging action therebetween when the set screw is tightened.

13. The barrel porting system according to claim 12, wherein the coupling mechanism comprises a wedge insert removably inserted into the shroud, the wedge insert including an upwardly extending entrapment projection which engages the porting device to prevent axial withdrawal from the shroud.

14. The barrel porting system according to claim 13, further comprising an axially oriented set screw received in a threaded longitudinal bore of the wedge insert, the set screw rotatable and linearly movable to engage a portion of the shroud to lock the wedge insert therein.

15. The barrel porting system according to claim 1, wherein the porting device is secured to the muzzle end of the barrel via a threaded coupling mechanism.

16. The barrel porting system according to claim 1, further comprising a front sight mounted on the shroud.

17. The barrel porting system according to claim 1, wherein the at least one gas discharge port comprises a pair a longitudinally elongated slots formed in the shroud and positioned over top of the gas collection plenum, the gas discharge ports each receiving gas directly from the gas collection plenum to vent the gas to atmosphere.

18. The barrel porting system according to claim 17, wherein the slots are angularly separated from each other on the shroud by an angle of about and including 60 to 90 degrees.

19. The barrel porting system according to claim 1, wherein the annular gas collection plenum is configured to receive combustion gas from the gas portholes, circulate the gas circumferentially around a circumference of the muzzle brake, and discharge the gas outwards through the at least one discharge port in the shroud to atmosphere.

20. A firearm comprising the barrel porting system according to claim 1, wherein the firearm comprises:

a frame or receiver supporting the barrel; and a trigger-actuated firing mechanism positioned in the frame or receiver, the firing mechanism including a trigger coupled to a movable striking member operable to discharge the firearm via a trigger pull;

wherein discharging the firearm causes combustion gas to flow outwards from the gas portholes into the gas collection plenum, circulate through the plenum to the at least one gas discharge port in the shroud, and then flow outwards from the at least one discharge port to atmosphere.

21. The firearm according to claim 20, wherein the firearm is a revolver or pistol.

22. A method for porting gas from a firearm comprising:

providing a firearm including a barrel including an axially extending barrel bore which defines a projectile pathway, and a muzzle device coupled to the barrel and in fluid communication with the barrel bore;

firing the firearm;

radially discharging combustion gas from the barrel bore through an array of gas portholes in the barrel in;

receiving the gas in an annular gas collection plenum defined by the muzzle device and formed by a recessed annular gas collection channel in the barrel, the gas collection plenum extending 360 degrees around a circumference of the muzzle device; and discharging the gas from the gas collection plenum through at least one gas discharge port formed in an outer shroud surrounding the muzzle device.

23. The method according to claim 22, when the array of gas portholes extend around the circumference of the muzzle device to vent gas into the gas collection plenum in all radial directions from the muzzle device.

24. The method according to claim 22, wherein the at least one gas discharge portion is located on an upper half of the shroud to vent gas in an at least partially upward direction.

25. A barrel porting system for a firearm comprising:

a barrel including a longitudinal axis, a muzzle end, and an axially extending barrel bore which defines a projectile pathway;

a plurality of gas portholes formed in a venting portion of the barrel in fluid communication with the barrel bore; and an outer shroud encircling at least the venting portion of the barrel, the shroud including at least one gas discharge port in fluid communication with the gas portholes of the barrel and arranged to vent combustion gas from firing the firearm in a generally upwards direction;

wherein the venting portion of the barrel comprises a recessed annular gas collection channel which receives the gas from the gas portholes, and wherein the annular gas collection channel is configured to receive combustion gas from the gas portholes, circulate the gas circumferentially around a circumference of the barrel, and discharge the gas outwards through the at least one discharge port in the shroud to atmosphere.

* * * * *